US010971819B2

(12) United States Patent
Shi et al.

(10) Patent No.: US 10,971,819 B2
(45) Date of Patent: Apr. 6, 2021

(54) MULTI-BAND WIRELESS SIGNALING

(71) Applicant: QUALCOMM Incorporated, San Diego, CA (US)

(72) Inventors: Guining Shi, San Diego, CA (US); Young Jun Song, San Diego, CA (US); Allen Minh-Triet Tran, San Diego, CA (US); Mohammad Ali Tassoudji, San Diego, CA (US); Elizabeth Wyrwich, San Diego, CA (US); Julio Zegarra, La Jolla, CA (US); Clinton James Wilber, San Diego, CA (US); Neil Burns, San Diego, CA (US); Jorge Fabrega Sanchez, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 71 days.

(21) Appl. No.: 16/276,957

(22) Filed: Feb. 15, 2019

(65) Prior Publication Data

US 2019/0260127 A1 Aug. 22, 2019

Related U.S. Application Data

(60) Provisional application No. 62/710,403, filed on Feb. 16, 2018.

(51) Int. Cl.

| | |
|---|---|
| ***H01Q 1/00*** | (2006.01) |
| ***H01Q 5/371*** | (2015.01) |
| ***H01Q 1/38*** | (2006.01) |

(Continued)

(52) U.S. Cl.

CPC ..... *H01Q 5/371* (2015.01); *H01Q 1/243* (2013.01); *H01Q 1/38* (2013.01); *H01Q 5/378* (2015.01);

(Continued)

(58) Field of Classification Search

CPC ..... H01Q 1/243; H01Q 21/28; H01Q 9/0421; H01Q 13/10; H01Q 1/44; H01Q 5/35;

(Continued)

(56) References Cited

U.S. PATENT DOCUMENTS

| | | | |
|---|---|---|---|
| 9,531,087 | B2 | 12/2016 | Ying et al. |
| 9,660,345 | B1 | 5/2017 | Gu et al. |
| 2011/0279338 | A1 | 11/2011 | Myszne et al. |

(Continued)

FOREIGN PATENT DOCUMENTS

| | | | |
|---|---|---|---|
| CN | 106374226 | A | 2/2017 |
| WO | 2017119643 | A1 | 7/2017 |

OTHER PUBLICATIONS

International Search Report and Written Opinion—PCT/US2019/018371—ISA/EPO—dated Apr. 25, 2019.

(Continued)

*Primary Examiner* — Monica C King

(74) *Attorney, Agent, or Firm* — Qualcomm Incorporated

(57) ABSTRACT

An antenna system for transducing radio-frequency energy includes: a first antenna sub-system comprising a plurality of radiators and a ground conductor, each of the plurality of radiators being sized and shaped to transduce millimeter-wave energy between first wireless signals and first electrical current signals; and a second antenna sub-system comprising a first radiator configured to transduce sub-6 GHz energy between second wireless signals and second electrical current signals, wherein the first radiator comprises the ground conductor.

29 Claims, 15 Drawing Sheets

(51) Int. Cl.

| | |
|---|---|
| ***H01Q 9/04*** | (2006.01) |
| ***H01Q 5/378*** | (2015.01) |
| ***H01Q 1/24*** | (2006.01) |
| ***H01Q 9/42*** | (2006.01) |
| ***H01Q 21/28*** | (2006.01) |

(52) U.S. Cl.
CPC ..... *H01Q 9/0421* (2013.01); *H01Q 9/42* (2013.01); *H01Q 21/28* (2013.01)

(58) Field of Classification Search
CPC ..... H01Q 5/357; H01Q 1/38; H01Q 1/48; H01Q 21/24; H01Q 3/24; H01Q 5/371; H01Q 5/378; H01Q 5/47; H01Q 9/0414; H01Q 9/42; H04M 1/0202; H04M 1/026; H04M 1/236
See application file for complete search history.

(56) References Cited

U.S. PATENT DOCUMENTS

| | | | | |
|---|---|---|---|---|
| 2014/0125526 | A1* | 5/2014 | Hong | H01Q 1/243 343/700 MS |
| 2017/0062937 | A1 | 3/2017 | Ganchrow et al. | |
| 2017/0141465 | A1 | 5/2017 | Sharawi | |
| 2017/0214120 | A1* | 7/2017 | Lee | H01Q 21/293 |

OTHER PUBLICATIONS

Wang Y., et al., "Design of Compact Wideband Meandering Loop Antenna with a Monopole Feed for Wireless Applications", Progress in Electromagnetics Research Letters, vol. 73, 2018 , pp. 1-8.

* cited by examiner

MULTI-BAND WIRELESS SIGNALING

CROSS-REFERENCE TO RELATED APPLICATIONS

This application claims the benefit of U.S. Provisional Application No. 62/710,403, filed Feb. 16, 2018, entitled "DUAL-BAND ANTENNA SYSTEM," the entire contents of which are hereby incorporated herein by reference.

BACKGROUND

Wireless communication devices are increasingly popular and increasingly complex. For example, mobile telecommunication devices have progressed from simple phones, to smart phones with multiple communication capabilities (e.g., multiple cellular communication protocols, Wi-Fi, BLUETOOTH® and other short-range communication protocols), supercomputing processors, cameras, etc. Wireless communication devices have antennas to support communication over a range of frequencies.

It is often desirable to have multiple communication technologies, e.g., to enable multiple communication protocols concurrently, and/or to provide different communication capabilities. For example, as wireless communication technology evolves from 4G to 5G or to different wireless local area network (WLAN) standards, for example, mobile communication devices may be configured to communicate using different frequencies, including frequencies below 6 GHz often used for 4G and some WLAN communications, and millimeter-wave frequencies, e.g., above 23 GHz, for 5G and some WLAN communications. Communicating using different frequencies, however, may be difficult, especially using mobile wireless communication devices with small form factors.

SUMMARY

An example antenna system for transducing radio-frequency energy includes: a first antenna sub-system comprising a plurality of radiators and a ground conductor, each of the plurality of radiators being sized and shaped to transduce millimeter-wave energy between first wireless signals and first electrical current signals; and a second antenna sub-system comprising a first radiator configured to transduce sub-6 GHz energy between second wireless signals and second electrical current signals, wherein the first radiator comprises the ground conductor.

Implementations of such an antenna system may include one or more of the following features. The first radiator further includes a conductive portion physically separate from the ground conductor, the conductive portion including a first section and a second section, and the first section being physically separated from the ground conductor by less than a twentieth of a wavelength of the sub-6 GHz energy over a majority of at least one edge of the ground conductor. The first section includes a meander line, of a monopole, that is disposed within the twentieth of the wavelength of the sub-6 GHz energy over a majority of a perimeter of the ground conductor to parasitically or capacitively couple the sub-6 GHz energy between the ground conductor and the meander line. The ground conductor is rectangular with two length edges, a first width edge, and a second width edge, and the meander line is disposed within the twentieth of the wavelength of the sub-6 GHz energy over a majority of each of the two length edges, and a majority of the first width edge. The ground conductor is planar, the plurality of radiators overlap with the ground conductor transverse to a plane of the ground conductor, and the second section does not overlap with the ground conductor transverse to the plane of the ground conductor. The first section includes a first monopole portion and the second section includes a second monopole portion, the antenna system further including an aperture tuner communicatively coupled to the second monopole portion.

Also or alternatively, implementations of such an antenna system may include one or more of the following features. The second antenna sub-system defines an opening through which the millimeter-wave energy and the sub-6 GHz energy, from the ground conductor, can wirelessly pass. A length of the ground conductor is an odd multiple of a quarter of a wavelength of the sub-6 GHz energy ±10% of the wavelength. The antenna system further includes a display, and the first antenna sub-system and the second antenna sub-system extend outside a perimeter of the display by less than 10 mm. The first antenna sub-system and the second antenna sub-system are collocated, with the first antenna sub-system being disposed inside a volume bounded by the second antenna sub-system. The sub-6 GHz energy is first energy and has one or more first frequencies below 6 GHz, the second antenna sub-system further includes a first monopole portion and a second monopole portion, and the first monopole portion and the second monopole portion are configured to, in combination, radiate second energy with one or more second frequencies below 6 GHz. The one or more second frequencies are between 700 MHz and 960 MHz and/or between 1.7 GHz and 2.7 GHz, and the one or more first frequencies are between 1.25 GHz and 1.7 GHz.

Also or alternatively, implementations of such an antenna system may include one or more of the following features. The second antenna sub-system includes a feed electrically coupled to the ground conductor. The ground conductor is a first ground conductor, the antenna system further includes a printed circuit board that includes a second ground conductor, and the first ground conductor is electrically connected to the second ground conductor. The antenna system is disposed within a mobile device, and the first ground conductor is rectangular and is connected to the second ground conductor via a conducting rim or frame of the mobile device. The antenna system is disposed within a mobile device including a rim, and the first antenna sub-system is disposed in a gap provided by the rim. The first antenna sub-system is physically separate from the rim at at least one end of the gap.

Also or alternatively, implementations of such an antenna system may include one or more of the following features. The antenna system further includes a first sub-system feed structure including a plurality of conductive lines configured to communicatively couple the plurality of radiators to millimeter-wave signal circuitry disposed on a printed circuit board, and the plurality of conductive lines are disposed between conductive sheets and the conductive sheets are configured to couple the ground conductor to a ground plane of the printed circuit board. The second antenna sub-system comprises an inverted-F antenna having a first conductor end, a second conductor end, and an intermediate point between the first and second conductor ends, the second antenna sub-system including a first electrical connection coupled between the first conductor end and circuitry configured to at least one of supply the sub-6 GHz energy or receive the sub-6 GHz energy, the second antenna sub-system further including a second electrical connection coupled between the intermediate point and a ground plane of a device including the antenna system, the second conductor end being open. The second antenna sub-system comprises an inverted-F antenna having a first conductor end, a second conductor end, and an intermediate point between the first and second conductor ends, the second antenna sub-system including a first electrical connection coupled between the intermediate point and circuitry configured to at least one of supply the sub-6 GHz energy or receive the sub-6 GHz energy, the second antenna sub-system further including a second electrical connection coupled between the first conductor end and a ground plane of a device including the antenna system, the second conductor end being open. The antenna system is disposed within a wireless device, and the antenna system further includes an aperture tuner coupled between the first radiator of the second antenna sub-system and a ground plane of the wireless device. The second antenna sub-system comprises a loop antenna with a feed coupled between a first end of the second antenna sub-system and circuitry configured to at least one of supply the sub-6 GHz energy or receive the sub-6 GHz energy, and with a ground connection coupled between a second end of the second antenna sub-system and a ground plane of a device including the antenna system. The plurality of radiators and the ground conductor of the first antenna sub-system are disposed in a module, the first electrical current signals correspond to millimeter wave signals, and the module further includes circuitry configured to upconvert intermediate-frequency signals to the first electrical current signals or to downconvert the first electrical current signals to intermediate-frequency signals.

An example of a method of transducing radio-frequency energy includes: transducing millimeter-wave energy by a plurality of millimeter-wave radiators backed by a ground conductor; and transducing sub-6 GHz energy by a sub-6 GHz antenna sub-system by: exciting the ground conductor with at least a first portion of the sub-6 GHz energy to radiate the first portion of the sub-6 GHz energy from the ground conductor; or receiving a second portion of the sub-6 GHz energy as wireless signals at the ground conductor, converting the wireless signals into electrical signals, and providing the electrical signals to a feed of the sub-6 GHz antenna sub-system; or a combination thereof.

Implementations of such a method may include one or more of the following features. Exciting the ground conductor includes capacitively coupling the first portion of the sub-6 GHz energy from a conductive portion of the sub-6 GHz antenna sub-system to the ground conductor, the conductive portion being physically separate from the ground conductor. The capacitively coupling includes capacitively coupling the first portion of the sub-6 GHz energy from a meander line to the ground conductor. The capacitively coupling includes coupling the first portion of the sub-6 GHz energy from the meander line to the ground conductor along at least portions of at least three edges of the ground conductor. Transducing the sub-6 GHz energy includes transducing first energy with one or more first frequencies between 700 MHz and 960 MHz and/or between 1.7 GHz and 2.7 GHz using a monopole that is separate from the ground conductor, and transducing second energy with one or more second frequencies between 1.25 GHz and 1.7 GHz using the ground conductor, where the millimeter-wave energy has one or more frequencies above 23 GHz. The method further includes tuning a monopole radiator of the sub-6 GHz antenna sub-system to adjust a resonant frequency of the monopole radiator. Exciting the ground conductor includes electrically connecting a sub-6 GHz signal to the ground conductor.

DETAILED DESCRIPTION

Figure 1:
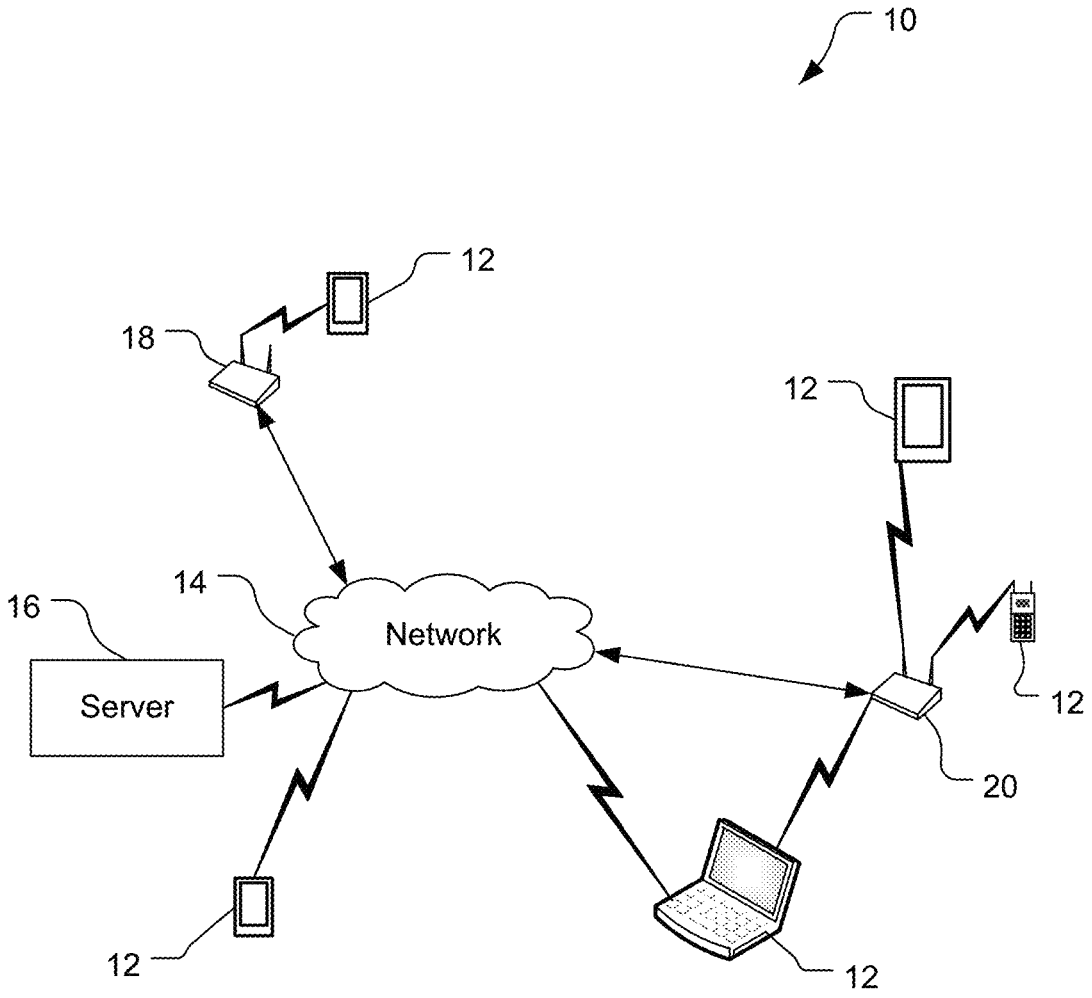
FIG. 1 is a schematic diagram of a communication system.

Techniques are discussed herein for communicating in multiple frequency bands using collocated antennas in a wireless communication device. For example, an array of millimeter-wave radiators may be collocated with a low-frequency radiator for a lower frequency band, e.g., a sub-6 GHz band. The array is fed with millimeter-wave energy for radiation by the array. The low-frequency radiator is fed with energy in a first low-frequency band for radiation by the low-frequency radiator. A ground plane of the millimeter-wave radiators may couple to or function as the low-frequency radiator when the low-frequency radiator is fed energy of a second low-frequency band, and the ground plane may radiate energy in the second low-frequency band. The ground plane may thus serve as a reference for the array of millimeter-wave radiators for the millimeter-wave energy and serve as a radiator, or part of a radiator, for the second low-frequency energy. The low-frequency radiator may comprise, for example, a monopole with a portion of the monopole comprising a meander line that is in close proximity to the ground plane to capacitively couple the second low-frequency energy to the ground plane for radiation by the ground plane. As another example, energy may be capacitively coupled to the ground plane by a line that is not part of a radiator. As another example, the ground plane may receive sub-6 GHz energy to be radiated by a feed line directly electrically connected to the ground plane. Other configurations, however, may be used.

Items and/or techniques described herein may provide one or more of the following capabilities, as well as other capabilities not mentioned. Communication using different frequency bands of a wireless communication device may be provided with good isolation between signals of the different frequency bands and with good antenna performance from collocated antennas. A conductive device may serve a dual purpose as a reference plane for radiation in one frequency band, e.g., a millimeter-wave frequency band, and as a radiator in another frequency band, e.g., a sub-6 GHz frequency band. Communication bandwidth may be increased relative to single-band communications. Carrier aggregation ability may be enhanced, and as a result, system throughput increased. A multi-band antenna system may be provided with a small form factor, e.g., a 4G/5G antenna system, or an antenna system configured for use with sub-6 GHz WLAN standards and millimeter-wave WLAN standards, may occupy the same form factor as a 4G or WLAN sub-6 GHz only antenna system. An antenna system may be provided with a sub-6 GHz antenna sub-system and a millimeter-wave antenna sub-system with little or no additional space used compared to having a sub-6 GHz antenna sub-system without a millimeter-wave antenna sub-system. Other capabilities may be provided and not every implementation according to the disclosure must provide any, let alone all, of the capabilities discussed. Further, it may be possible for an effect noted above to be achieved by means other than that noted, and a noted item/technique may not necessarily yield the noted effect.

Referring to FIG. 1, a communication system 10 includes mobile devices 12, a network 14, a server 16, and access points (APs) 18, 20. The system 10 is a wireless communication system in that components of the system 10 can communicate with one another (at least some times using wireless connections) directly or indirectly, e.g., via the network 14 and/or one or more of the access points 18, 20 (and/or one or more other devices not shown, such as one or more base transceiver stations). For indirect communications, the communications may be altered during transmission from one entity to another, e.g., to alter header information of data packets, to change format, etc. The mobile devices 12 shown are mobile wireless communication devices (although they may communicate wirelessly and via wired connections) including mobile phones (including smartphones), a laptop computer, and a tablet computer. Still other mobile devices may be used, whether currently existing or developed in the future. Further, other wireless devices (whether mobile or not) may be implemented within the system 10 and may communicate with each other and/or with the mobile devices 12, network 14, server 16, and/or APs 18, 20. For example, such other devices may include internet of thing (IoT) devices, medical devices, home entertainment and/or automation devices, etc. The mobile devices 12 or other devices may be configured to communicate in different networks and/or for different purposes (e.g., 5G, Wi-Fi communication, multiple frequencies of Wi-Fi communication, satellite positioning, one or more types of cellular communications (e.g., GSM (Global System for Mobiles), CDMA (Code Division Multiple Access), LTE (Long-Term Evolution), etc.), Bluetooth®, etc.

Figure 2:
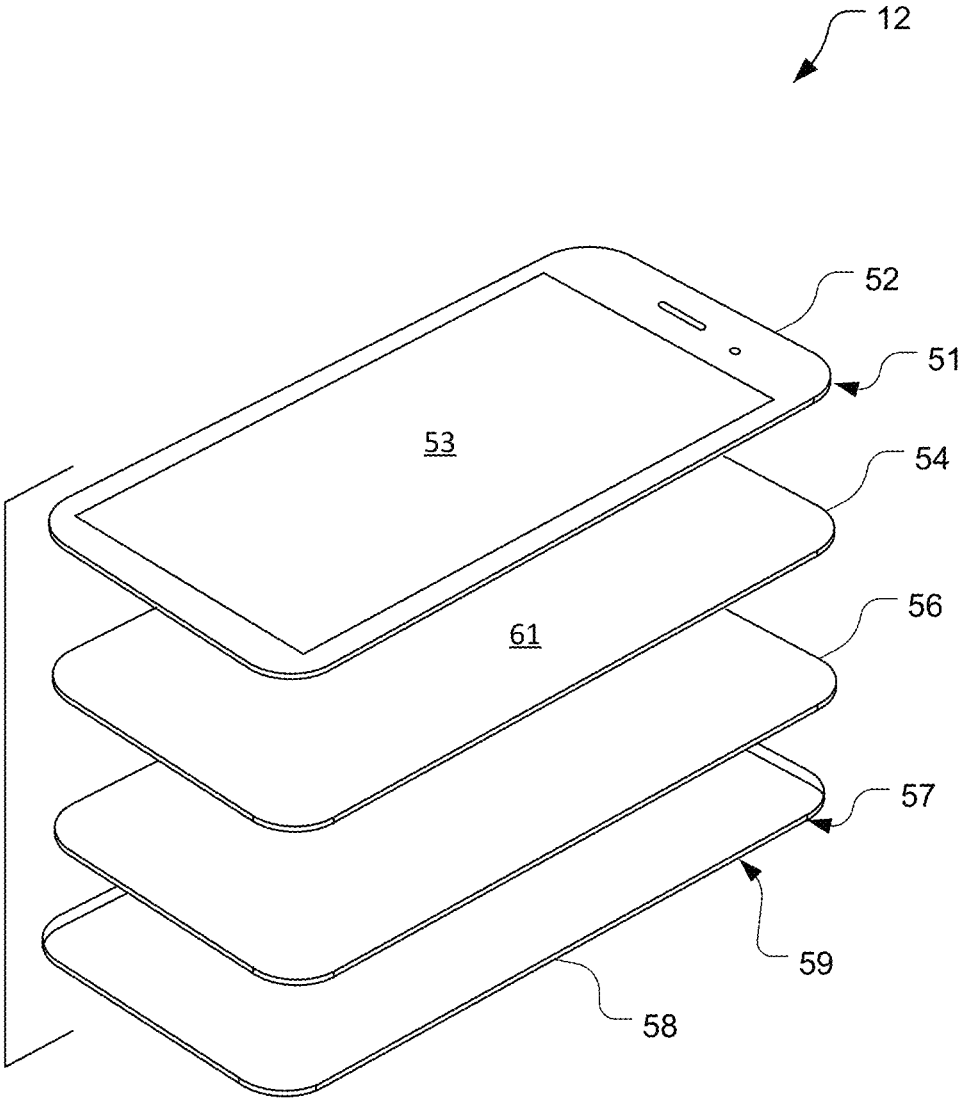
FIG. 2 is an exploded perspective view of simplified components of a mobile device shown in FIG. 1.

Referring to FIG. 2, an example of one of the mobile devices 12 shown in FIG. 1 includes a top cover 52, a display layer 54, a printed circuit board (PCB) layer 56, and a bottom cover 58. The mobile device 12 as shown may be a smartphone or a tablet computer but the discussion is not limited to such devices. The top cover 52 includes a screen 53. The bottom cover 58 has a bottom surface 59 and sides 51, 57 of the top cover 52 and the bottom cover 58 provide an edge surface. The top cover 52 and the bottom cover 58 comprise a housing that retains the display layer 54, the PCB layer 56, and other components of the mobile device 12 that may or may not be on the PCB layer 56. For example, the housing may retain (e.g., hold, contain) antenna systems, front-end circuits, an intermediate-frequency circuit, and a processor discussed below. The housing may be substantially rectangular, having two sets of parallel edges in the illustrated embodiment, and may be configured to bend or fold. In this example, the housing has rounded corners, although the housing may be substantially rectangular with other shapes of corners, e.g., straight-angled (e.g., 45°) corners, 90°, other non-straight corners, etc. Further, the size and/or shape of the PCB layer 56 may not be commensurate with the size and/or shape of either of the top or bottom covers or otherwise with a perimeter of the device. For example, the PCB layer 56 may have a cutout to accept a battery. Those of skill in the art will therefore understand that embodiments of the PCB layer 56 other than those illustrated may be implemented.

Figure 3:
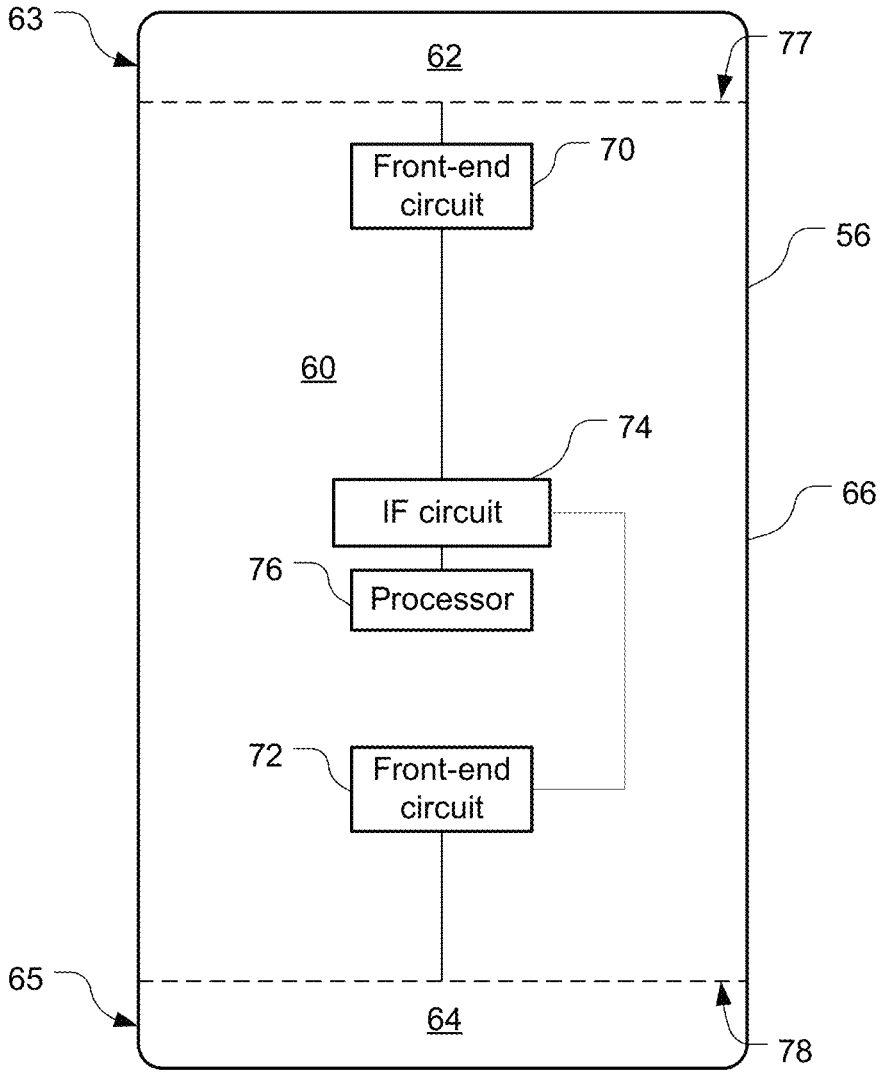
FIG. 3 is a top view of a printed circuit board layer, shown in FIG. 2, including antenna systems.

Referring also to FIG. 3, an example of the PCB layer 56 includes a main portion 60 and two antenna systems 62, 64. In the example shown, the antenna systems 62, 64 are disposed at opposite ends 63, 65 of the PCB layer 56, and thus, in this example, of the mobile device 12 (e.g., of the housing of the mobile device 12). The main portion 60 comprises a PCB 66 that includes front-end circuits 70, 72 (also called a radio frequency (RF) circuit), an intermediate-frequency (IF) circuit 74, and a processor 76. The front-end circuits 70, 72 are configured to provide signals to be radiated to the antenna systems 62, 64 and to receive and process signals that are received by, and provided to the front-end circuits 70, 72 from, the antenna systems 62, 64. The front-end circuits 70, 72 may be configured to convert received IF signals from the IF circuit 74 to RF signals (amplifying with a power amplifier as appropriate), and provide the RF signals to the antenna systems 62, 64 for radiation. The front-end circuits 70, 72 may be configured to convert RF signals received by the antenna systems 62, 64 to IF signals (e.g., using a low-noise amplifier and a mixer) and to send the IF signals to the IF circuit 74. The IF circuit 74 is configured to convert IF signals received from the front-end circuits 70, 72 to baseband signals and to provide the baseband signals to the processor 76. The IF circuit 74 is also configured to convert baseband signals provided by the processor 76 to IF signals, and to provide the IF signals to the front-end circuits 70, 72. The processor 76 is communicatively coupled to the IF circuit 74, which is communicatively coupled to the front-end circuits 70, 72, which are communicatively coupled to the antenna systems 62, 64, respectively. In some embodiments, transmission signals may be provided from the IF circuit 74 to the antenna system 62 and/or 64 by bypassing the front-end circuit 70 and/or 72, for example when further upconversion is not required by the front-end circuit 70 and/or 72. Signals may also be received from the antenna system 62 and/or 64 by bypassing the front-end circuit 70 and/or 72. In other embodiments, a transceiver separate from the IF circuit 74 is configured to provide transmission signals to and/or receive signals from the antenna system 62 and/or 64 without such signals passing through the front-end circuit 70 and/or 72. In some embodiments, the front-end circuits 70, 72 are configured to amplify, filter, and/or route signals from the IF circuit 74 without upconversion to the antenna systems 62, 64. Similarly, the front-end circuits 70, 72 may be configured to amplify, filter, and/or route signals from the antenna systems 62, 64 without downconversion to the IF circuit 74.

In FIG. 3, the dashed lines separating the antenna systems 62, 64 from the PCB 66 indicate functional separation of the antenna systems 62, 64 (and the components thereof) from other portions of the PCB layer 56. Portions of the antenna systems 62, 64 may be integral with the PCB 66, being formed as integral components of the PCB 66. One or more components of the antenna system 62 and/or the antenna system 64 may be formed integrally with the PCB 66, and one or more other components may be formed separate from the PCB 66 and mounted to the PCB 66, or otherwise made part of the PCB layer 56. Alternatively, each of the antenna systems 62, 64 may be formed separately from the PCB 66 and mounted to the PCB 66 and coupled to the front-end circuits 70, 72, respectively. In some examples, one or more components of the antenna system 62 may be integrated with the front-end circuit 70, e.g., in a single module or on a single circuit board. For example, the front-end circuit 70 may be physically attached to the antenna system 62, e.g., attached to a back side of a ground plane of the antenna system 62. Also or alternatively, one or more components of the antenna system 64 may be integrated with one or more components of the front-end circuit 72, e.g., in a single module or on a single circuit board. For example, an antenna of the antenna system 62 may have front-end circuitry electrically (conductively) coupled and physically attached to the antenna while another antenna may have the front-end circuitry physically separate, but electrically coupled to the other antenna. The antenna systems 62, 64 may be configured similarly to each other or differently from each other. For example, one or more components of either of the antenna systems 62, 64, may be omitted. As an example, the antenna system 62 may include 4G and 5G radiators while the antenna system 64 may not include (may omit) a 5G radiator. In other examples, an entire one of the antenna systems 62, 64 may be omitted. While the antenna systems 62, 64 are illustrated as being disposed at the top and bottom of the mobile device 12, other locations of the antenna system 62 and/or 64 may be implemented. For example, one or more antenna systems may be disposed on a side of the mobile device 12. Further, more antenna systems that the two antenna systems 62, 64 may be implemented in the mobile device 12.

Figure 5:
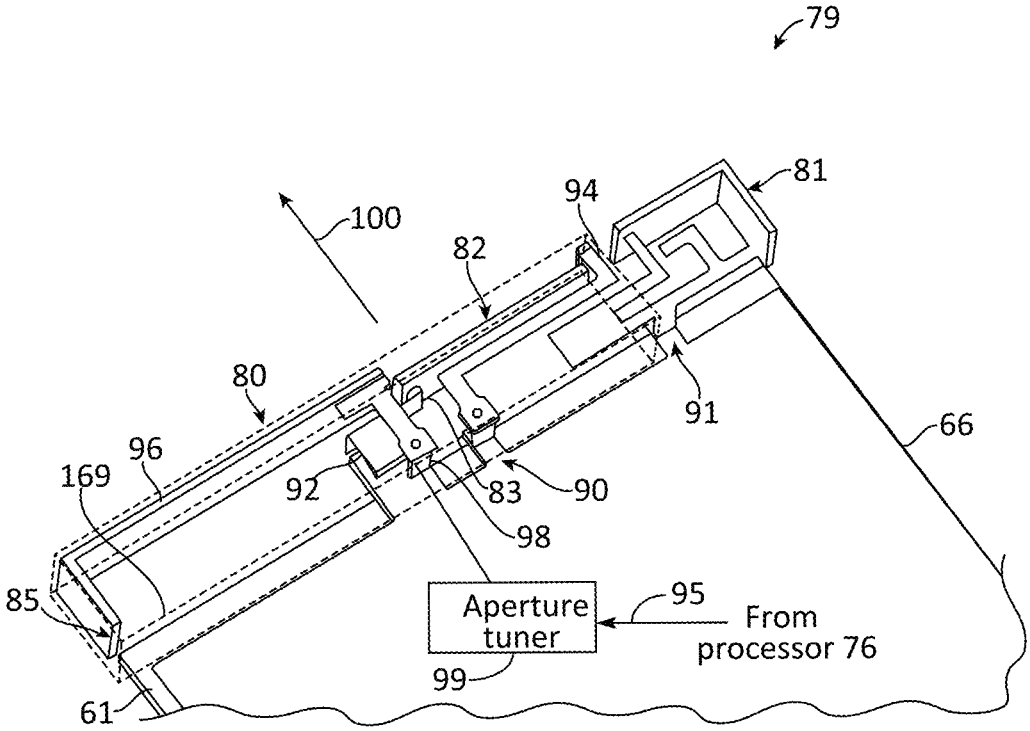
FIGS. 5-6 are simplified perspective views of an example antenna of one of the antenna systems shown in FIG. 3.
Figure 6:
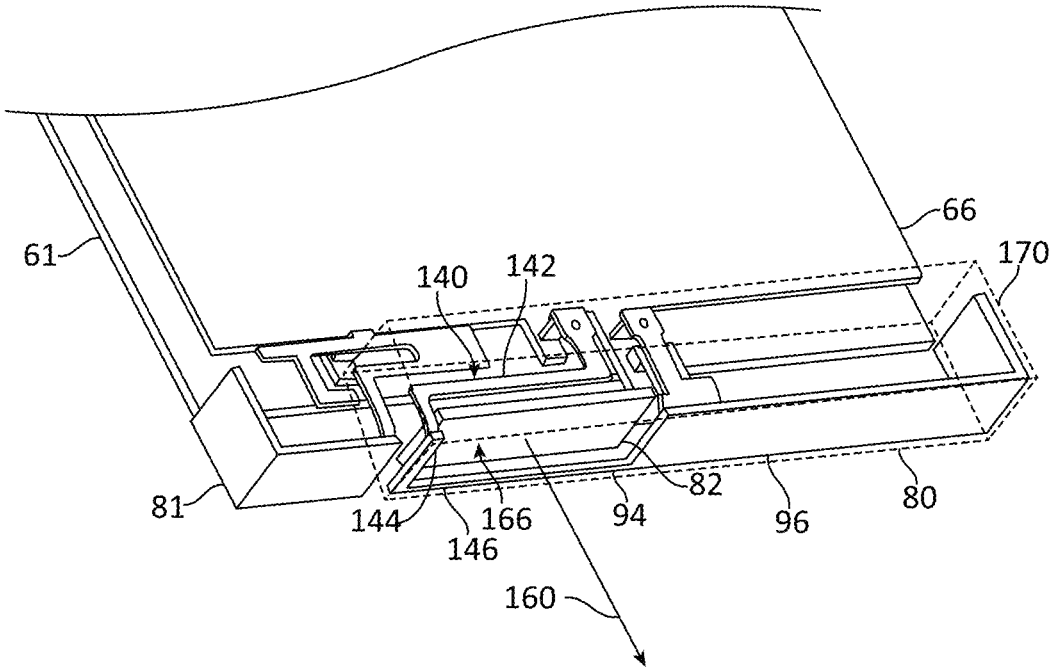

A display 61 (see FIG. 5-6) of the display layer 54 may roughly cover the same area as the PCB 66, or may extend over a significantly larger area (or at least over different regions) than the PCB 66, and may serve as a system ground plane for at least portions, e.g., feed lines, of the antenna systems 62, 64 (and possibly other components of the device 12) although the PCB 66 may also provide a ground plane for components of the system. The display 61 may be coupled to the PCB 66 to help the PCB 66 serve as a ground plane. The display 61 is disposed below the antenna system 62 and above the antenna system 64 (with "above" and "below" being relative to the mobile device 12, i.e., with a top of the mobile device 12 being above other components regardless of an orientation of the device 12 relative to the Earth). In some embodiments, the antenna systems 62, 64 may have widths approximately equal to a width of the display 61. The antenna systems 62, 64 may extend less than about 10 mm (e.g., 8 mm) from edges, here ends 77, 78, of the display 61 (shown in FIG. 3 as coinciding with ends of the PCB 66 for convenience, although as shown in FIGS. 5-6, ends of the PCB 66 and the display 61 may not coincide). This may provide sufficient electrical characteristics for communication using the antenna systems 62, 64 without occupying a large area within the device 12.

Figure 4:
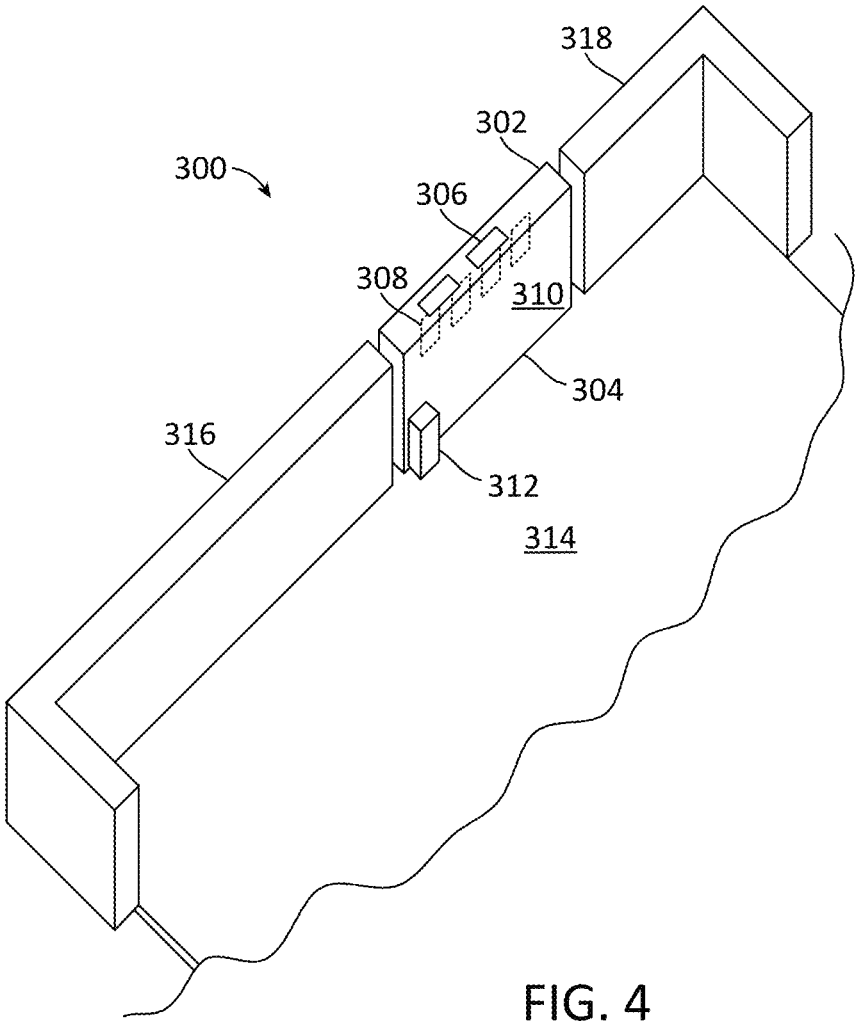
FIG. 4 is a perspective view of an antenna system.

Referring also to FIG. 4, an antenna system 300, that is an example of the of the antenna system 62, includes a first antenna sub-system 302 and a second antenna sub-system 304. While the antenna system 300 is described in the context of the antenna system 62, the antenna system 300 may be an example of the antenna system 64 or another antenna system in the mobile device 12.

The sub-system 302 includes multiple radiators 306, 308 and shares a portion of the sub-system 302 with the sub-system 304. The radiators 306, 308 are shown as generic boxes, but may be any of a variety of radiator types such as monopoles, dipoles, patch radiators, etc. The radiators 306 may be different from the radiators 308. The radiators 306, 308 may be configured to transduce millimeter-wave energy (e.g., above 23 GHz). The radiators 308 of the sub-system 302 are disposed between a ground conductor 310 of the sub-system 302 and a periphery of the mobile device 12. The ground conductor 310 is shared by the sub-systems 302, 304, with the sub-system 304 being configured to provide energy to and/or receive energy from the ground conductor 310. The energy provided to and/or received from the ground conductor 310 may have one or more frequencies below 6 GHz, with the ground conductor 310 being sized and shaped to transduce the desired frequency(ies). The sub-system 304 includes at least first and second conductive portions, e.g., the ground conductor 310 being the first conductive portion. The ground conductor 310 of the sub-system 304 is a conductor that serves as a ground for the radiators 306 and/or 308, and may be electrically coupled through a coupler 312 to a ground plane 314, e.g., of the PCB 66. One or more portions 316, 318 of a rim may provide one or more further conductive portions of the sub-system 304 (e.g., the portion 316 providing the second portion of the sub-system 304). The portions 316, 318 may provide portions of a low-frequency radiator (e.g., of a monopole) in some embodiments. In some embodiments, the portion 318 may provide another antenna (or portion thereof) and/or a parasitic element for the sub-system 304. In some embodiments, one or both of the portions 316, 318 may be elements separate from a rim of the mobile device 12.

The sub-systems 302, 304 are coupled to front-end circuitry (not shown in FIG. 4) to receive (to be fed) energy to be radiated by the sub-systems 302, 304 and/or to convey energy wirelessly received by the sub-systems 302, 304 to the front-end circuitry. For example, one or more portions of the sub-system 302 may be coupled through the coupler 312 to the front-end circuitry. As another example, the sub-system 304 may be coupled to front-end circuitry directly by conductive lines (not shown in FIG. 4), e.g., as shown and discussed with respect to FIG. 5 for an example implementation. As another example, the portion 316 and/or the portion 318 may be directly fed by electrical connectors (not shown in FIG. 4).

Figure 11:
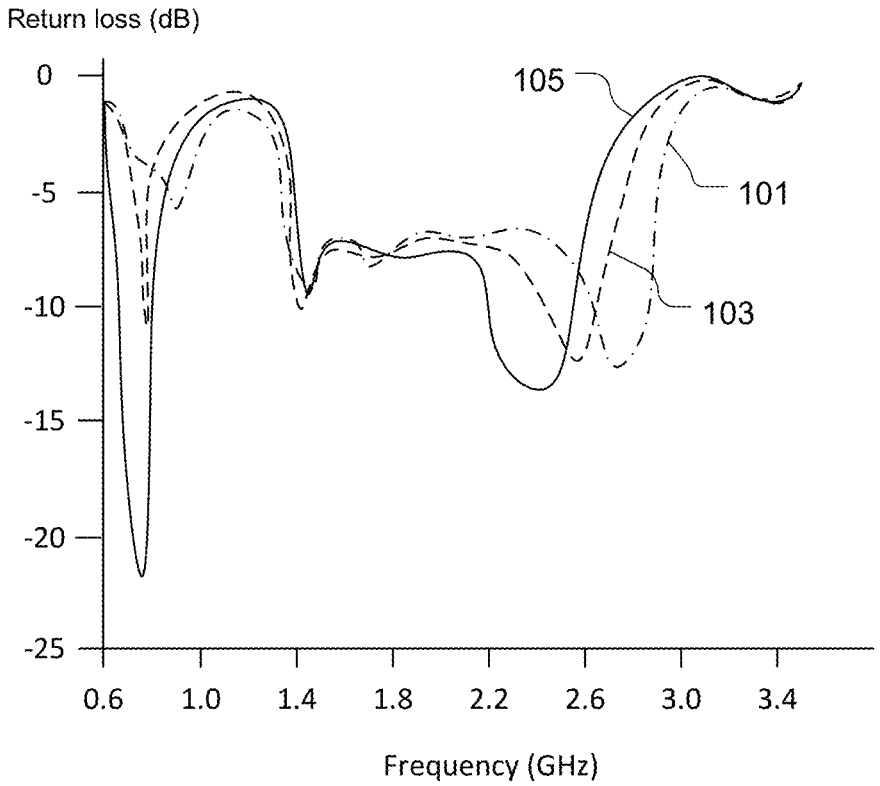
FIG. 11 is a graph of return loss of a radiator shown in FIG. 5 with three different aperture tuner values.
Figure 12:
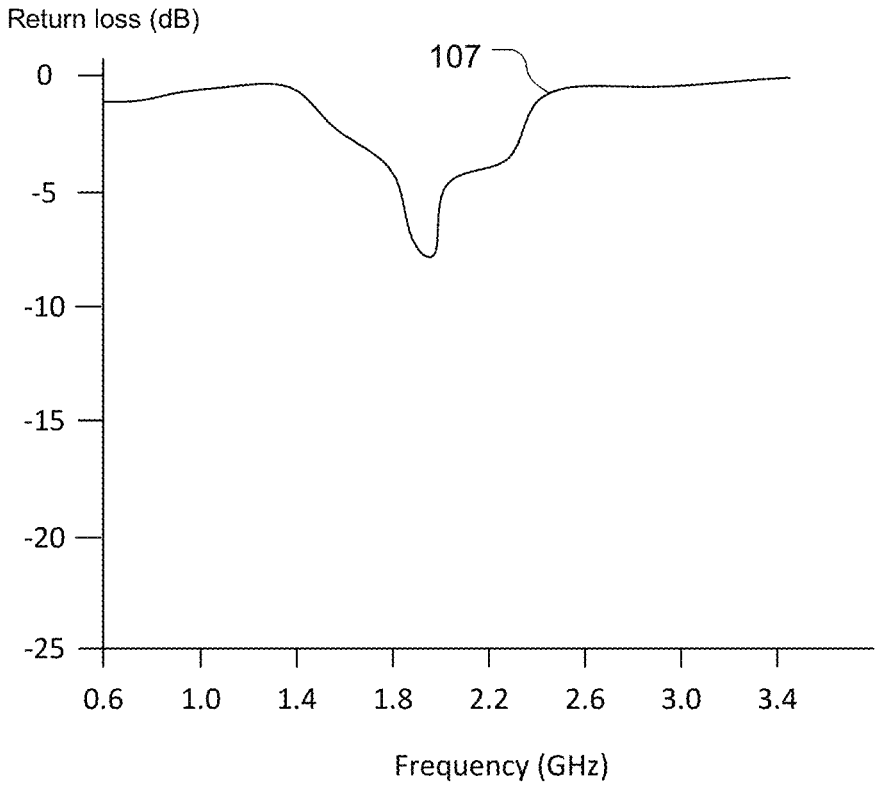
FIG. 12 is a graph of return loss of another radiator shown in FIG. 5.

Referring also to FIGS. 5-6, an antenna system 79, that is an example of the antenna system 62, includes two low-frequency antenna sub-systems 80, 81, and a multi-band antenna sub-system 82 (e.g., a dual-band antenna sub-system). Each of the antenna sub-systems 80, 81, 82 is electrically coupled to the PCB 66 at a respective feed 90, 91, 92 for conveying energy between a respective one of the antenna sub-systems 80, 81, 82 and the PCB 66 (i.e., to or from the respective sub-systems 80, 81, 82). While referred to as "feeds," the feeds 90, 91, 92 are electrical connections and use of the terms "feed" or "feeds" does not mean that energy is only provided to the sub-systems 80, 81, 82 as energy may flow bi-directionally in the connections 90, 91, 92, e.g., be provided by the sub-systems 80, 81, 82 through the feeds 90, 91, 92, e.g., to front-end circuitry. Further, energy from the "feed" may not be provided directly to a radiating element; for example, in some implementations signals received over the feed 92 may be amplified, filtered, upconverted, and/or phase shifted prior to being provided to a radiator such as one or more of the radiators 306 and/or 308. Each of the feeds 90, 91, 92 may include an appropriate impedance-matching circuit. The feed 92 of the sub-system 82 is, in this example, a flexible printed circuit (FPC) having conductive lines disposed between conductive sheets, although other feed configurations may be used. The conductive sheets provide isolation for the conductive lines carrying intermediate-frequency signals to and from the sub-system 82, and may serve as a ground extension for low-frequency radiation by the multi-band antenna sub-system 82 (discussed further below). For example, the conductive lines may be coupled between circuitry on the PCB 66 such as the IF circuit 74 and circuitry or radiators implemented in the antenna sub-system 82, while the conductive sheets couple a ground conductor of the antenna sub-system 82 to a system ground, such as a ground plane or element coupled to ground in the PCB 66. The multi-band antenna sub-system 82 is configured to transduce (i.e., radiate and/or receive) millimeter-wave energy, e.g., above 23 GHz (such as about 28 GHz), and includes a ground conductor 83 for millimeter-wave energy circuitry. The ground conductor 83 may be configured (e.g., sized and shaped) to radiate, in conjunction with the sub-system 80, sub-6 GHz energy, e.g., about 1.4 GHz (e.g., between about 1.25 GHz and about 1.7 GHz). These frequencies are examples, and the sub-system 82 may be configured to transduce other frequencies. Also, the discussion herein may refer to radiation (e.g., using terms such as radiators and radiate), but the discussion applies to receipt of energy as well as emission of energy as antennas are typically bi-directional. The antenna sub-systems 80, 81 may be configured to radiate sub-6 GHz energy, with the sub-system 80 configured to radiate energy in lower and higher bands of sub-6 GHz frequencies and the sub-system 81 configured to radiate energy in a higher band of sub-6 GHz frequencies. For example, simulated return loss plots 101, 103, 105 are shown in FIG. 11 for the return loss at the feed 90 (with tuning impedances of 10 nH, 15 nH, and 22 nH, respectively) for the combination of the sub-system 80 and the sub-system 82, and a simulated return loss plot 107 shown in FIG. 12 for the sub-system 81. By being configured to radiate energy of a particular frequency or frequency band, a device is configured to radiate energy with return loss below a threshold at the frequency or over the frequency band. For example, the threshold return loss may be −2 dB, −5 dB, −6 dB, −10 dB, or other amount. The front-end circuit 70 may include tuning circuitry for one or more of the antenna sub-systems 80, 81, 82.

Sub-6 GHz energy (e.g., signals) has a frequency or frequencies of 6 GHz or below. For example, 3G, 4G, and some 5G applications may use frequencies at or below 6 GHz and techniques discussed herein may be used for such frequencies and such applications. Further, techniques discussed herein may be used for applications at other frequencies, e.g., frequencies of 10 GHz or below.

The low-frequency antenna sub-system 80 is configured to radiate sub-6 GHz energy. In this example, the low-frequency antenna sub-system 80 includes a monopole, including a starboard section 94 (a starboard monopole portion), a port section 96 (a port monopole portion), and an aperture tuner connection 98. The terms "starboard" and "port" are based on the orientation shown in FIG. 5, with the antenna system 79 assumed to be disposed at a top of the mobile device 12 such that an upward direction (relative to the device 12) is indicated by an arrow 100, with starboard thus being to the right in FIG. 5 and port to the left in FIG. 5. The terms "starboard" and "port" are used herein for convenience and reference only, and do not require a specific location or orientation of the antenna sub-system 80. For example, the antenna system 79 could be configured as a mirror image of that shown in FIG. 5. The aperture tuner connection 98 is electrically coupled to the port section 96 and to an aperture tuner 99 that is electrically coupled to the processor 76 (see FIG. 3). While the aperture tuner 99 is shown separated from the aperture tuner connection 98 for clarity, the aperture tuner 99 may be close to the aperture tuner connection 98, or even disposed between the aperture tuner connection 98 and the port section 96. The aperture tuner 99 (or the connection 98) may be coupled to ground, e.g., ground of the PCB 66.

The sections 94, 96 and the aperture tuner 99 are configured such that, in combination, and with the aperture tuner 99 selected to provide appropriate tuning, the antenna sub-system 80 will radiate well at one or more desired frequencies. The sections 94, 96 have a combined length 97 (see FIG. 8) that is close to a quarter of a wavelength (in a dielectric of the system 79) at a desired radiation frequency, e.g., a center frequency of a desired range of radiation frequencies. For example, the length 97 may be between 65% and 90% of the quarter wavelength. The antenna sub-system 82, and in particular the ground conductor 83, enhances radiation of the antenna sub-system 80, e.g., by supplementing the section 96 by coupling energy (capacitively by mutual coupling) from the section 96 and re-radiating at least some of the coupled energy. Thus, the antenna sub-system 82 may increase the bandwidth of the antenna sub-system 80. The combination of the sub-system 80, the ground conductor 83, the feed 90, and the connection 98 form an inverted-F antenna (as can also be seen in FIG. 8). The antenna system 79 could be reconfigured to provide the sub-system 80 as a loop antenna, e.g., by moving the connection 98 to an end 85 of the sub-system 80. The tuning provided by the aperture tuner 99 will adjust a resonant frequency (or resonant frequencies) of the monopole of the antenna sub-system 80. Here, the sections 94, 96, the antenna sub-system 82, and the aperture tuner 99 are configured such that the sections 94, 96 and the ground conductor 83 of the sub-system 82 will radiate energy over a range of about 700 MHz to about 960 MHz and over a range of about 1.25 GHz to about 2.7 GHz with acceptable efficiency (e.g., a return loss at the feed 90 being less than −3 dB over these ranges with appropriate tuning by the aperture tuner 99). For example, the port section 96 may have a horizontal arm portion 102 with a length of about 30 mm and a vertical arm portion 104 with a length of about 8 mm, and with the aperture tuner 99 configured to provide selectable inductances, e.g., of 10 nH, 15 nH, and 22 nH, which yielded respective simulated return loss plots 101, 103, 105 as shown in FIG. 11. In this example, the aperture tuner 99 could be implemented using a single-pole, triple-throw (SP3T) switch. Other configurations of the aperture tuner 99, however, may be used (e.g., a single-pole, quadruple-throw switch if four different inductances may be selected). Which of the selectable inductances is provided by the aperture tuner 99 at any given time may be selected by the processor 76, and the aperture tuner 99 may provide the selected inductance in accordance with a control signal 95 received by the aperture tuner 99 from the processor 76. The processor 76 may select the inductance to be provided by the tuner 99 based on a desired band of operation of the antenna sub-system 80. For example, different cellular service providers use different carrier frequencies and thus the processor 76 may produce the control signal to select an inductance of the aperture tuner 99 such that the antenna sub-system 80 radiates energy well (e.g., with acceptable efficiency and/or return loss) at the carrier frequency(ies) for a presently-used service provider.

The multi-band antenna sub-system 82 is configured to radiate at significantly different frequencies, e.g., frequencies and/or frequency bands separated by more than a factor of two. In this example, the multi-band antenna sub-system 82 is configured (e.g., sized, shaped, and made of appropriate components with appropriate materials) to radiate energy at millimeter-wave frequencies (e.g., above 23 GHz) and at low frequencies (in this case, low frequencies being frequencies below 6 GHz). The multi-band antenna sub-system 82 may have numerous different configurations for providing multi-band capability.

The front-end circuit 70 (see FIG. 3) may include one or more low-frequency sources and one or more high-frequency sources. A low-frequency source is coupled to each of the feeds 90, 91 and is configured to provide appropriate low-frequency energy to each of the low-frequency antenna sub-systems 80, 81. The one or more high-frequency sources is(are) coupled to the feed line 92 and configured to provide the multi-band high-frequency energy to multi-band antenna sub-system 82. The sources may be configured to convert intermediate-frequency signals from the IF circuit 74 into sub-6 GHz and mm-wave-frequency signals, respectively, and provide those signals to the feeds 90, 91, 92, respectively. If the IF circuit 74 is omitted (e.g., if it is not needed), then the sources may use signals (e.g., baseband signals) directly from the processor 76 to produce the sub-6 GHz and mm-wave-frequency signals, respectively. In some embodiments, the sources may couple signals to or from one or more of the feeds 90, 91 without significantly converting the frequency of the signals. In yet other embodiments, one or more of the feeds 90, 91 may be coupled to circuitry, configured to send and/or receive low-frequency signals, other than the front-end circuit 70. In some embodiments, an IF signal is provided to the antenna sub-system 82 over the feed 92, and circuitry in the antenna sub-system 82 upconverts the IF signal to a millimeter-wave signal for transmission (and/or downconverts a received signal for provision to the IF circuit over the feed 92). The circuity may also amplify, phase shift, etc. an RF signal for use with multiple antenna elements in the antenna sub-system 82.

Figure 7:
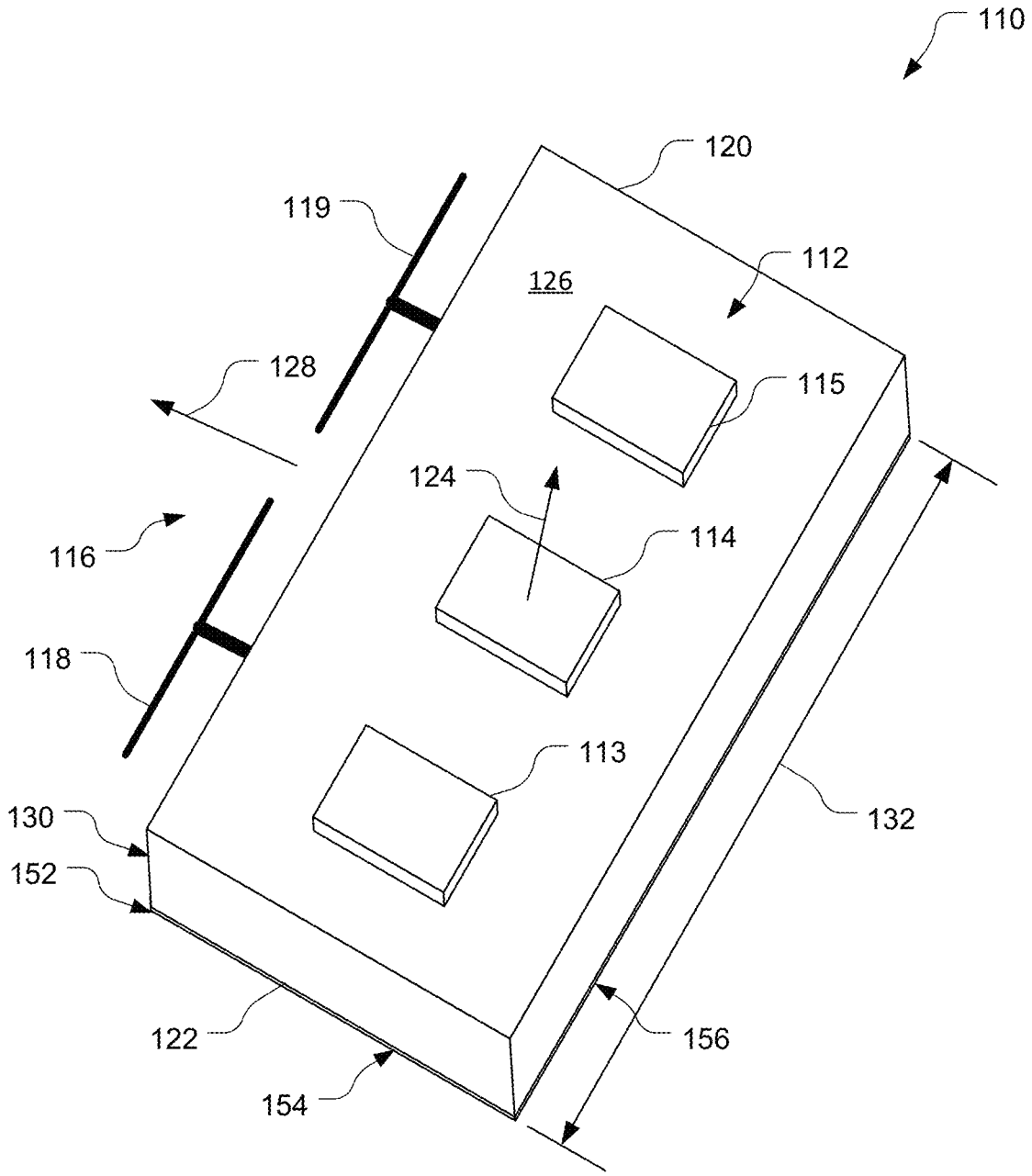
FIG. 7 is a simplified perspective view of an example of a millimeter-wave antenna sub-system shown in FIGS. 5-6.

Referring also to FIG. 7, an antenna module 110 is an example of the multi-band antenna sub-system 82. The antenna module 110 includes an array 112 of patch radiators 113, 114, 115, an array 116 of dipoles 118, 119, a dielectric 120, and a ground conductor 122. The ground conductor 122 is disposed below the patch radiators 113-115 such that the patch radiators 113-115 overlap with the ground conductor 122. Here, the radiators 113-115 each completely overlap with the ground conductor 122 (i.e., projections of the radiators 113-115 transverse (perpendicular) to planes of the radiators 113-115 would be entirely on the ground conductor 122), although other configurations with less than complete overlap may be possible. The arrays 112, 116 are configured to radiate millimeter-wave energy, while the ground conductor 122 provides a reference for the arrays 112, 116, serving as a counterpoise for the arrays 112, 116 for millimeter-wave radiation. The array 112 is configured and disposed to radiate energy outward, e.g., in a direction 124 perpendicular to a plane 126 of the dielectric 120, although energy from the array 112 may be steered by appropriate phase differences of the energy radiated by the patch radiators 113-115. In some embodiments the module 110 may be disposed in the device 12 such that the direction 124 substantially aligns with the direction 100 (FIG. 5) and/or 160 (FIG. 6). The array 116 is configured and disposed to radiate energy outwardly, e.g., in a direction 128 perpendicular to a side surface 130 of the dielectric 120, although energy from the array 116 may be steered by appropriate phase differences of the energy radiated by the dipoles 118-119. Thus, given the orientation of the antenna sub-system 82, the array 116 radiates energy from a front face of the mobile device 12. The energy radiated by the array 112 and the array 116 may be of similar frequencies, e.g., millimeter-wave frequencies such as frequencies above 23 GHz. As described above, the front-end circuit 70 may be physically attached to the antenna system. Thus, while not illustrated in FIG. 7, the front-end circuit 70 may be integrated within the antenna module 110, for example attached to a back side of the ground conductor 122. IF signals received at the module 110 from the IF circuit 74 may be upconverted to RF signals and the RF signals provided to the patch radiators 113-115 and/or the dipoles 118, 119 for transmission. Similarly, RF signals wirelessly received at the patch radiators 113-115 and/or the dipoles 118-119 may be downconverted by the module 110 to IF signals and provided to the IF circuit 74. The configuration of FIG. 7 is an example only, as are the arrays 112, 116, and thus numerous other configurations of the antenna module 110 may be used, including numerous configurations of arrays of radiators (e.g., different types of radiators, different quantities of arrays, different quantities of radiators within an array, etc.) other than those shown.

The ground conductor 122 is also configured to radiate one or more low, e.g., sub-6 GHz, frequencies, thus serving as a sub-6 GHz radiator in addition to serving as a counterpoise for the arrays 112, 116 for millimeter-wave radiation. Here, the ground conductor 122 has a rectangular shape, with a length 132 of approximately an odd multiple of a quarter of a wavelength (e.g., an odd multiple of a quarter wavelength ±10% of the wavelength) at the frequency of energy to be transduced (i.e., radiated and/or received). The length 132 may not be exactly an odd multiple of a free-space quarter of a wavelength at the frequency of energy to be radiated due, e.g., to the dielectric 120 and other components near the ground conductor 122. For example, the ground conductor 122 may radiate energy effectively above 1 GHz, e.g., between about 1.25 GHz and about 1.7 GHz (such as at about 1.4 GHz), with the length 132 of the ground conductor 122 being about 22.5 mm. The ground conductor 122 acts as a parasitic element to the antenna sub-system 80, in particular for the frequency range at which the ground conductor is configured to radiate. The ground conductor 122, in conjunction with the monopole of the antenna sub-system 80, and the PCB 66, form a resonant structure that radiates at the over-1 GHz frequency(ies).

Figure 10:
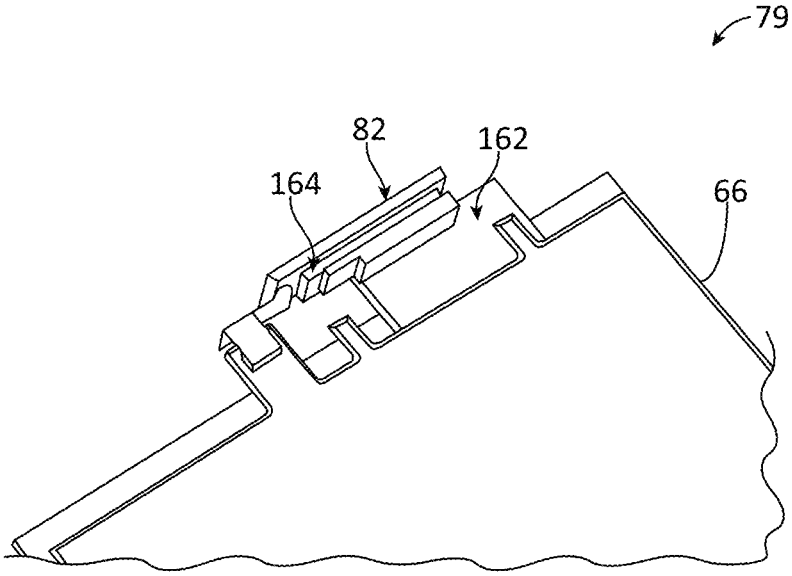
FIG. 10 is a simplified perspective view of an antenna system shown in FIGS. 5-6 showing a heat spreader and a radio-frequency shield.

Other components may be included in the antenna system 79 than those shown. For example, referring to FIG. 10 (in which the antenna sub-systems 80 and 81 are omitted for clarity), the antenna system 79 may include a ceramic heat spreader 162, and an RF shield 164. The heat spreader 162 is connected to the PCB 66 and the RF shield 164 and is configured to help dissipate heat, e.g., produced by an RF integrated circuit (RFIC) in the antenna sub-system 82. The heat spreader 162 may comprise a non-electrically-conductive material.

Figure 8:
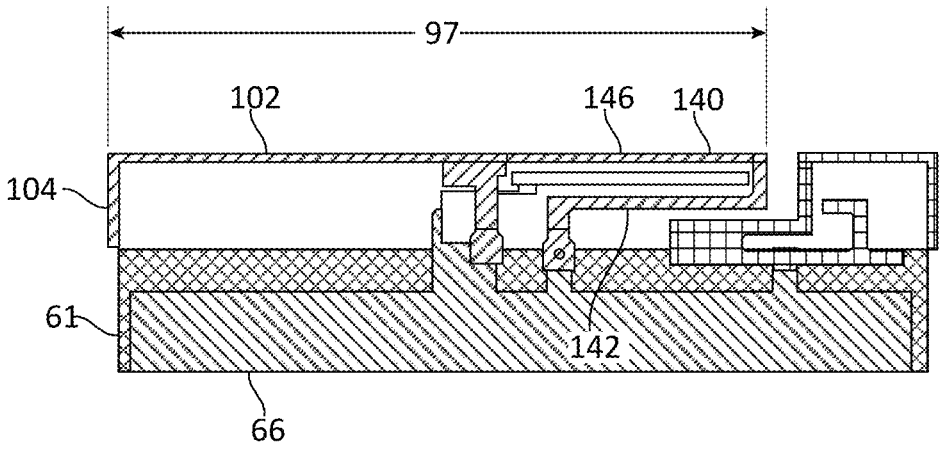
FIG. 8 is a front plan view of the antenna system shown in FIGS. 5-6.
Figure 9:
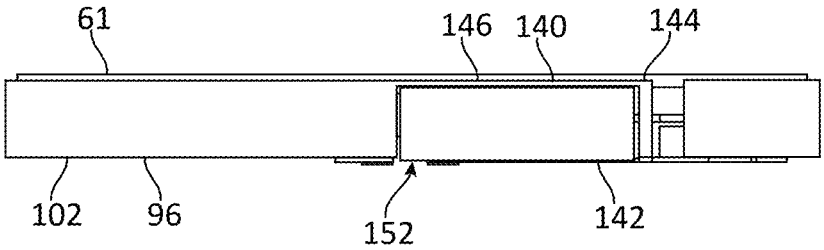
FIG. 9 is a top plan view of the antenna system shown in FIGS. 5-6.

Referring more particularly again to FIG. 6, with further particular reference to FIGS. 7-9, a meander line 140 is configured to radiate energy and to couple energy to the antenna sub-system 82 for radiation. The meander line 140 includes the starboard section 94 of the antenna sub-system 80 for radiating energy. The starboard section 94 provides a portion of the monopole of the antenna sub-system 80, and thus helps to radiate low-frequency energy in a range of frequencies that the antenna sub-system 80 (including the monopole and the aperture tuner 99) is configured to radiate when fed the low-frequency energy via the feed 90. In this example, while the feed 90 may be coupled to the IF circuit 74, energy is provided by the IF circuit 74 to the feed 90 at a frequency substantially equivalent to the frequency at which energy will be radiated from the antenna sub-system 80. Portions of the meander line 140 are disposed in close proximity to a portion of a periphery of the ground conductor 122 such that the meander line can capacitively couple with the ground conductor 122 to wirelessly (i.e., without electrical touching/connecting) couple (transfer) energy to the ground conductor 122, e.g., energy of a frequency that the ground conductor 122 is configured to radiate. For example, a portion of the meander line 140 may be disposed within a tenth (e.g., less than a twentieth or less than a fortieth) of a wavelength at the frequency of energy to be coupled of the ground conductor 122 (i.e., displaced from the ground conductor 122 less than a tenth (e.g., less than a twentieth or less than a fortieth) of a wavelength at the frequency of energy to be coupled, e.g., less than 5 mm (or 2.5 mm or 1.25 mm to couple energy at 6 GHz, or less than 20 mm, 10 mm, or 5 mm to couple energy at 1.5 GHz). In the example shown, a first portion 142 of the meander line 140 extends parallel to and in close proximity with, e.g., less than 3 mm from (such as between 1 mm and 0.5 mm from), a side edge 152 (FIGS. 7 and 9) of the ground conductor 122. A second portion 144 of the meander line 140 extends parallel to and in close proximity with, e.g., less than 3 mm from (such as between 1 mm and 0.5 mm from), an end edge 154 (FIG. 7) of the ground conductor 122. A third portion 146 of the meander line 140 extends parallel to and in close proximity with, e.g., less than 3 mm from (such as between 1 mm and 0.5 mm from), a side edge 156 (FIG. 7) of the ground conductor 122, opposite the side edge 152 of the ground conductor 122. Another end edge of the ground conductor 122 is not shown in FIG. 7 and the meander line 140, in this example, does not run parallel to that end of the ground conductor 122. The first, second, and third portions 142, 144, 146 of the meander line 140 combine to be disposed in close proximity with a majority of a perimeter of the ground conductor 122. In this example, the meander line 140 is in close proximity with a majority (here all, i.e., the full length) of the end edge 154, a majority (here all, i.e., the full length) of the side edge 156, and a majority (here about ¾ of a length) of the side edge 152. With the ground conductor 122 being rectangular, and not square, as shown, the side edge 152 and the side edge 156 may each be considered a length edge, and the end edge 154 considered a width edge. The example proximities provided are not limiting, and other separations may be used. The meander line 140 is close enough to the ground conductor 122 to transfer energy to the ground conductor 122 wirelessly (e.g., through air) that the ground conductor 122 can radiate. For example, with the portions 142, 144, 146 spaced from the edges 152, 154, 156 by less than 1 mm, respectively, the meander line 140 may transfer energy, e.g., between about 1.25 GHz and about 1.7 GHz to the ground conductor 122 such that a return loss of better than −2 dB (e.g., better than −8 dB at about 1.4 GHz) may be realized at the feed 90 for the antenna sub-system 80.

The meander line 140 may be configured and disposed to limit interference with energy radiated by the ground conductor 122. Here, for example, the first portion 142 of the meander line is disposed below a plane of the ground conductor 122 (with the antenna system 79 being at a top of the mobile device 12), being disposed inwardly from a top of the mobile device 12, toward the PCB 66. Further, in this example, the second and third portions 144, 146 of the meander line 140 are disposed outwardly of a perimeter of the ground conductor 122. The starboard section 94 of the monopole of the antenna sub-system 80 defines an opening 166 through which sub-6 GHz energy and millimeter-wave energy can radiate from the multi-band antenna sub-system 82. An upward projection of the ground conductor 122 perpendicular to a plane of the ground conductor 122, i.e., along a line 160 (FIG. 6), would not intersect the meander line 140. The antenna sub-system 80, and in particular the meander line 140 does not overlap with the ground conductor 122 transverse to a plane of the ground conductor 122, or a thickness of the ground conductor 122, although a meander line with a different configuration may overlap a portion of the ground conductor 122. In the example shown, the antenna sub-system, and in particular the meander line 140, defines an opening through which millimeter-wave energy can wirelessly pass, e.g., to and/or from the antenna module 110, and through which sub-6 GHz energy can wirelessly pass to and/or from the ground conductor 122.

Referring again to FIGS. 5-6, the low-frequency antenna sub-system 80 and the multi-band antenna sub-system 82 are collocated. The antenna sub-systems 80, 82 are collocated. In this example, a rectangular parallelepiped 169 bounding the antenna sub-system 80 also includes the antenna sub-system 82. That is, the antenna sub-system 82 is disposed within the rectangular parallelepiped 169 that bounds the antenna sub-system 80; the antenna sub-system 82 is disposed in a volume (here the parallelepiped 169) bounded by the antenna sub-system 80. The antenna sub-systems 80, 82 thus share a single volume defined by the rectangular parallelepiped 169 (or any volume containing the rectangular parallelepiped 169). The rectangular parallelepiped 169 bounds the antenna sub-system 80 in that the rectangular parallelepiped 169 is the smallest rectangular parallelepiped that contains the antenna sub-system 80, here overlapping/sharing multiple edges of the antenna sub-system 80. Other configurations are possible, e.g., where a parallelepiped bounding one antenna sub-system would not include the other antenna sub-system, or not fully include the other antenna sub-system. For example, the volume of the sub-system 80 may partially enclose the sub-system 82, or the volumes of the sub-systems 80, 82 may be distinct, e.g., with the sub-systems 80, 82 disposed adjacent to each other, but with the sub-systems 80, 82 configured, and disposed close enough to each other, to capacitively couple energy from the sub-system 80 to the sub-system 82. For example, a meander line of the sub-system 80 may be in close proximity with at least one edge of a ground conductor of the sub-system 82, although possibly bordering less of the ground conductor than the meander line 140 borders the sub-system 82 as shown in FIGS. 6, 8, and 9.

Figure 13:
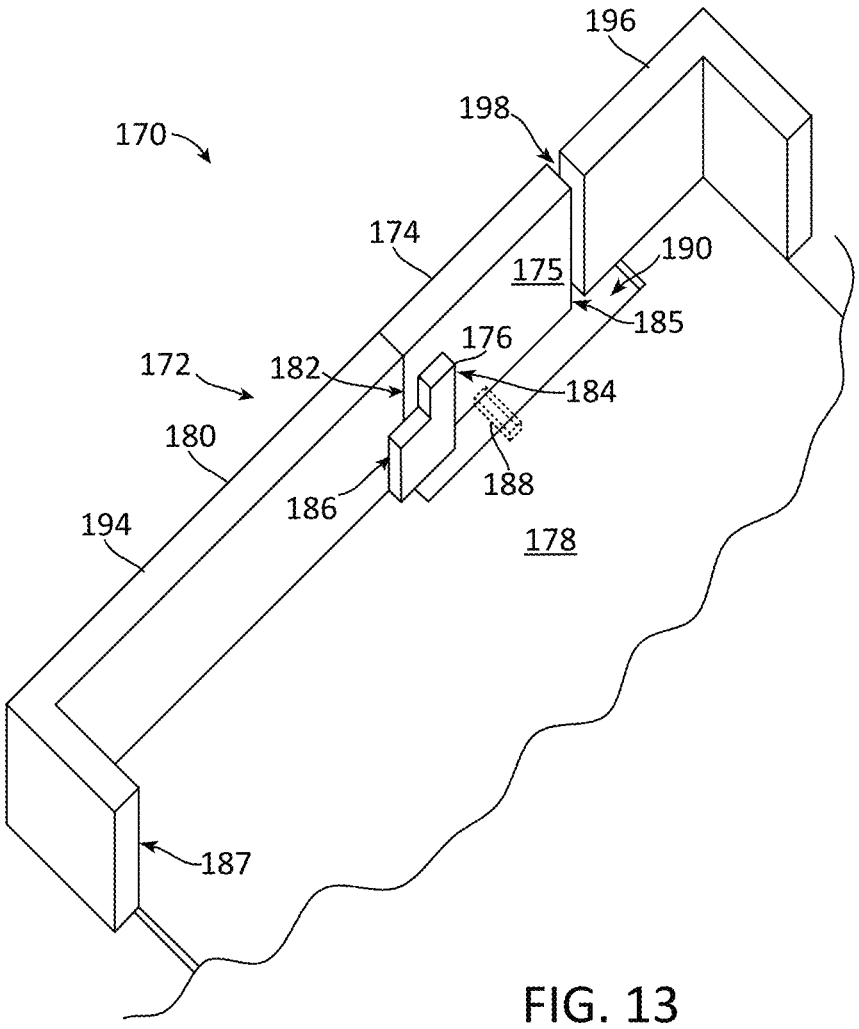
FIG. 13 is a simplified perspective view of another example antenna of one of the antenna systems shown in FIG. 3.

Referring to FIG. 13, with further reference to FIGS. 1-3, an antenna system 170, that is another example of the antenna system 62, includes a low-frequency antenna sub-system 172, a multi-band antenna sub-system 174, and a ground connection/feed 176. While the antenna system 170 is described in the context of the antenna system 62, the antenna system 170 may also be an example of the antenna system 64 or another antenna system in the mobile device 12.

Figure 14:
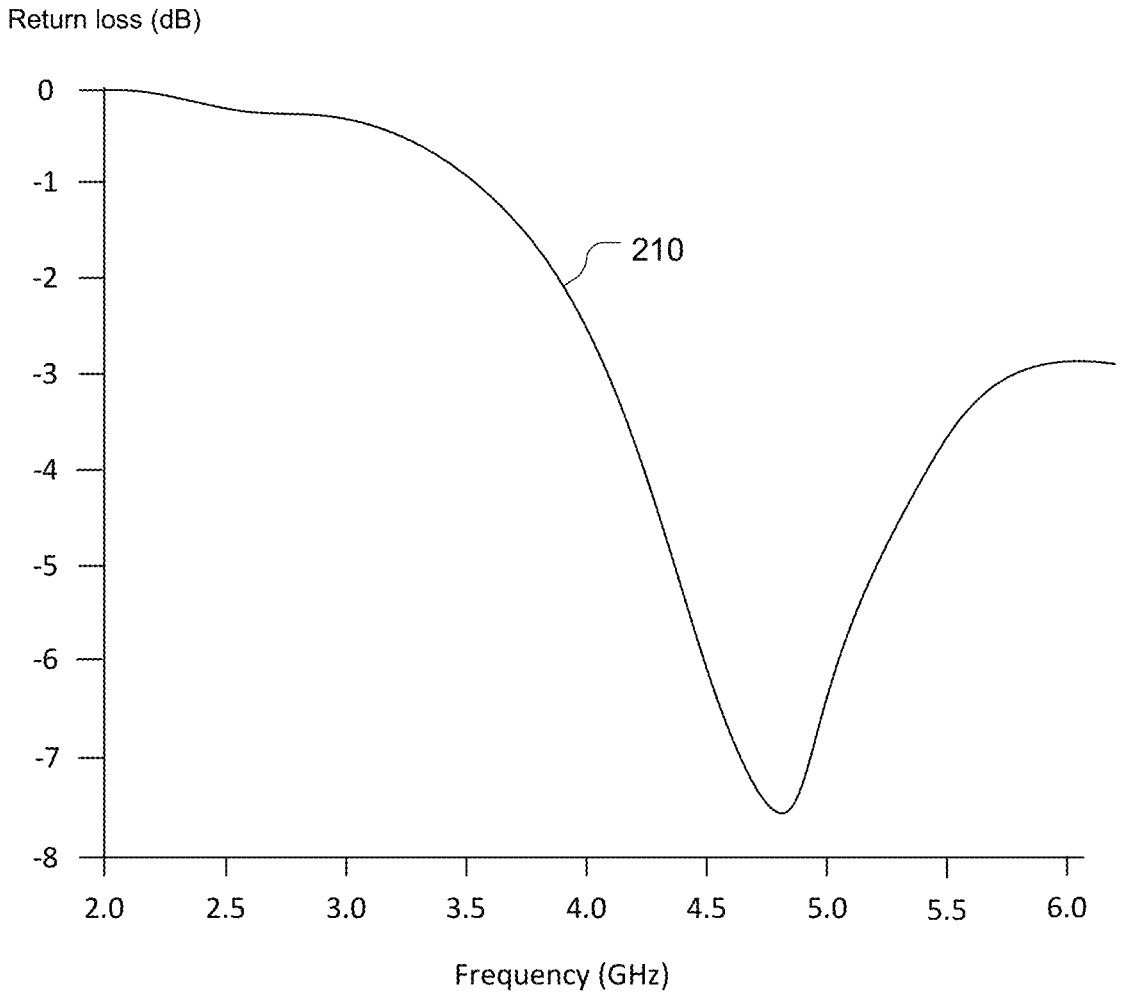
FIG. 14 is a graph of return loss of a radiator shown in FIG. 13.

The multi-band antenna sub-system 174 may be configured similarly to the antenna module 110 shown in FIG. 7. The multi-band antenna sub-system 174 may be coupled to a first portion 194 of a rim (or frame) 180 of the mobile device 12 at an end 182 of the multi-band antenna sub-system 174. The sub-system 174 may be connected to the PCB ground 178 via the ground connection/feed 176 (although the sub-system 174 may not be connected to the PCB ground 178 through the ground connection/feed 176). Further, digital and RF signals are conveyed to/from the sub-system 174 via the ground connection/feed 176. Radiators of the multi-band antenna sub-system 174 may be configured to radiate energy of relatively high frequencies, e.g., mm-wave frequencies (e.g., above 23 GHz). A ground plane 175 (e.g., the ground conductor 122 shown in FIG. 7) of the multi-band antenna sub-system 174 may also provide a portion of the low-frequency antenna sub-system 172 and may be configured to radiate relatively low-frequency energy, e.g., energy with a frequency below 6 GHz, e.g., as shown in a simulated return loss plot 210 shown in FIG. 14 for a frequency range from 2 GHz to 6 GHz. Depending on the return loss threshold, the antenna sub-system 172 may be configured to radiate over different frequencies in this range, for example at 4.5 GHz-5 GHz when the threshold is approximately −6 dB or 2.8 GHz-6 GHz when the threshold is approximately −0.2 dB, as illustrated in FIG. 14 (although other thresholds and other ranges are possible). The low-frequency energy may be conveyed between the low-frequency antenna sub-system 172 and the PCB (not shown) by a feed portion 184 of the ground connection/feed 176. Signal conveying portions of the ground connection/feed 176 for the high-frequency signals and the low-frequency signals may be physically separate and electrically isolated from each other. The ground connection/feed 176 may be connected to the ground plane 175 of the multi-band antenna sub-system 174 to convey energy to or from a radiator of the low-frequency antenna sub-system 172. A ground contact portion 186 of the ground connection/feed 176 electrically connects (couples) the ground plane 175, e.g., at the end 182, to the PCB ground 178. Each of the feeds for the sub-systems 172, 174 may include an appropriate impedance-matching circuit. The antenna system 170 can provide radiation at substantially different frequency bands, e.g., sub-6 GHz and mm-wave (e.g., over 23 GHz), with little or no additional space used compared to having a sub-6 GHz antenna sub-system without a mm-wave antenna sub-system. To help the sub-system 174 radiate the low-frequency energy, an opening 190 is provided in the PCB to provide some separation over at least a portion of a length of the sub-system 174. Alternatively, instead of the opening 190, metal could be absent from (e.g., removed from) the PCB ground 178, e.g., over a similarly sized and located region as the opening 190.

The sub-system 172 in combination with the ground connection/feed 176 provides, in this example, an inverted-F antenna. Other configurations, however, may be used. For example, a low-frequency antenna sub-system may be configured as a loop antenna, e.g., being fed at one end of a conductor and grounded at another end of the conductor. For example, an end 185 of the ground plane 175 can be fed and an end 187 of the first portion 194 of the rim 180 grounded, or vice versa, or the end 182 may be grounded as shown in FIG. 13 while the end 187 is fed. In any of these configurations, a tuner may be included in the ground connection.

Other configurations may be used. For example, while the ground connection/feed 176 shown in FIG. 13 provides both ground and feed connections near each other, the ground and feed points may be further separated. For example, the sub-system 172 may be grounded to the PCB ground 178 at the end 182 where the ground plane 175 of the sub-system 174 meets the first portion 194 of the rim 180, and a feed 188 (shown in dashed lines as this is an alternative configuration) may be provided that is displaced from the ground connection. As shown, the feed 188 is displaced from the end 182 toward a second portion 196 of the rim 180 (although the second portion 196 is not electrically connected to the first portion 194 of the rim 180; the antenna sub-system 174 may be disposed in a cutout or gap 198 of the rim 180, with the end 185 physically spaced from the portion 196), with the feed 188 being coupled and configured to convey low-frequency (e.g., sub-6 GHz) signals between an appropriate integrated circuit of the PCB and the ground conductor 175 of the sub-system 172. In such configuration, one portion of the ground connection/feed 176 may couple the ground plane 175 to system ground and another portion of the ground connection/feed 176 may couple high-frequency radiators (e.g., the radiators 306 and/or 308) of the antenna sub-system 174 to one or more high-frequency and/or intermediate-frequency sources. In some embodiments, the ground plane 175 is not coupled directly to the PCB ground 178, as is illustrated in FIG. 13, but rather is coupled to the ground plane 175 through the first portion 194 of the rim (or frame) 180.

Figure 15A:
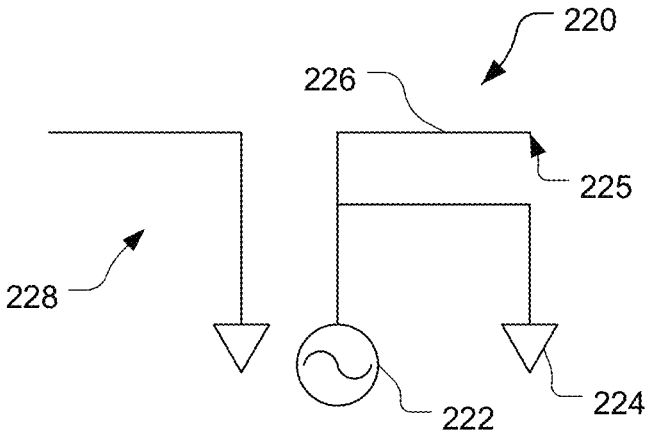
FIGS. 15A-15C are simplified circuit diagrams of example antenna sub-systems.
Figure 15B:
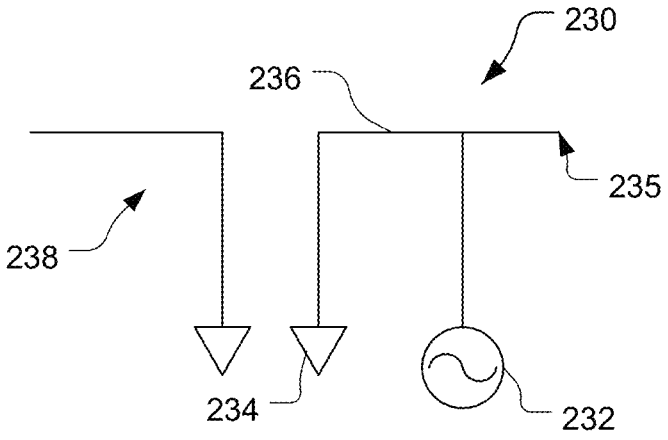
Figure 15C:
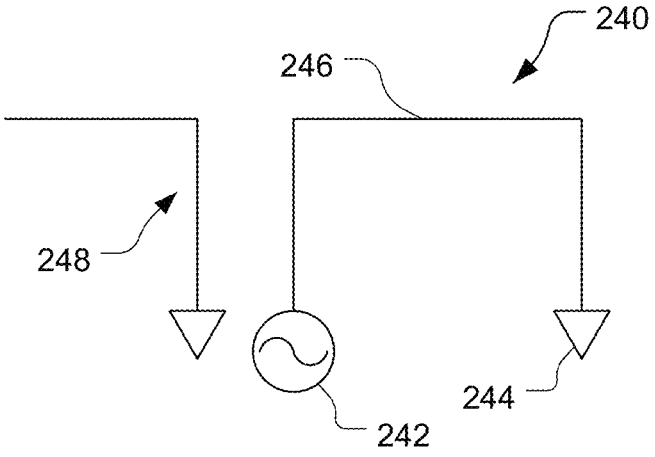

Referring to FIGS. 15A, 15B, 15C, with further reference to FIGS. 5 and 13, the antenna subsystem 80 shown in FIG. 5, the low-frequency antenna sub-system 172 shown in FIG. 13, and an antenna sub-system configured similarly to the antenna sub-system 172 but with a loop radiator instead of an inverted-F radiator, may be represented by simplified circuits 220, 230, 240, respectively. The circuit 220 includes a source 222 (e.g., the front-end circuit 70 shown in FIG. 3), a ground 224 (e.g., provided by the aperture tuner 99) connected between the source 222 and an end 225 (e.g., the end 85) of a radiating conductor 226 (e.g., the monopole section 96). A parasitic element 228 may be provided, e.g., by a piece (e.g., strip) of metal (e.g., the sub-system 82 and in particular the ground conductor 83 of the sub-system 82) to enhance radiation bandwidth (e.g., over a frequency range that is contiguous to an original frequency range without the parasitic element 228 and/or over a range that is non-contiguous with the original range). The circuit 230 includes a source 232 (e.g., the front-end circuit 70 shown in FIG. 3) and a ground 234 (e.g., the ground 178), with the source 232 connected between the ground 234 and an end 235 of a radiating conductor 236 (e.g., the ground plane 175 and the end 185). A parasitic element 238 (e.g., the second portion 196 of the rim 180) may be provided to enhance bandwidth. The circuit 240 includes a source 242 and a ground 244 disposed at opposite ends of a radiating conductor 246 (e.g., the ends 185, 182 of the ground plane 175). A parasitic element 248 (e.g., the second portion 196 of the rim 180 if connected to ground, e.g., the PCB ground 178) may be provided to enhance bandwidth.

Figure 16:
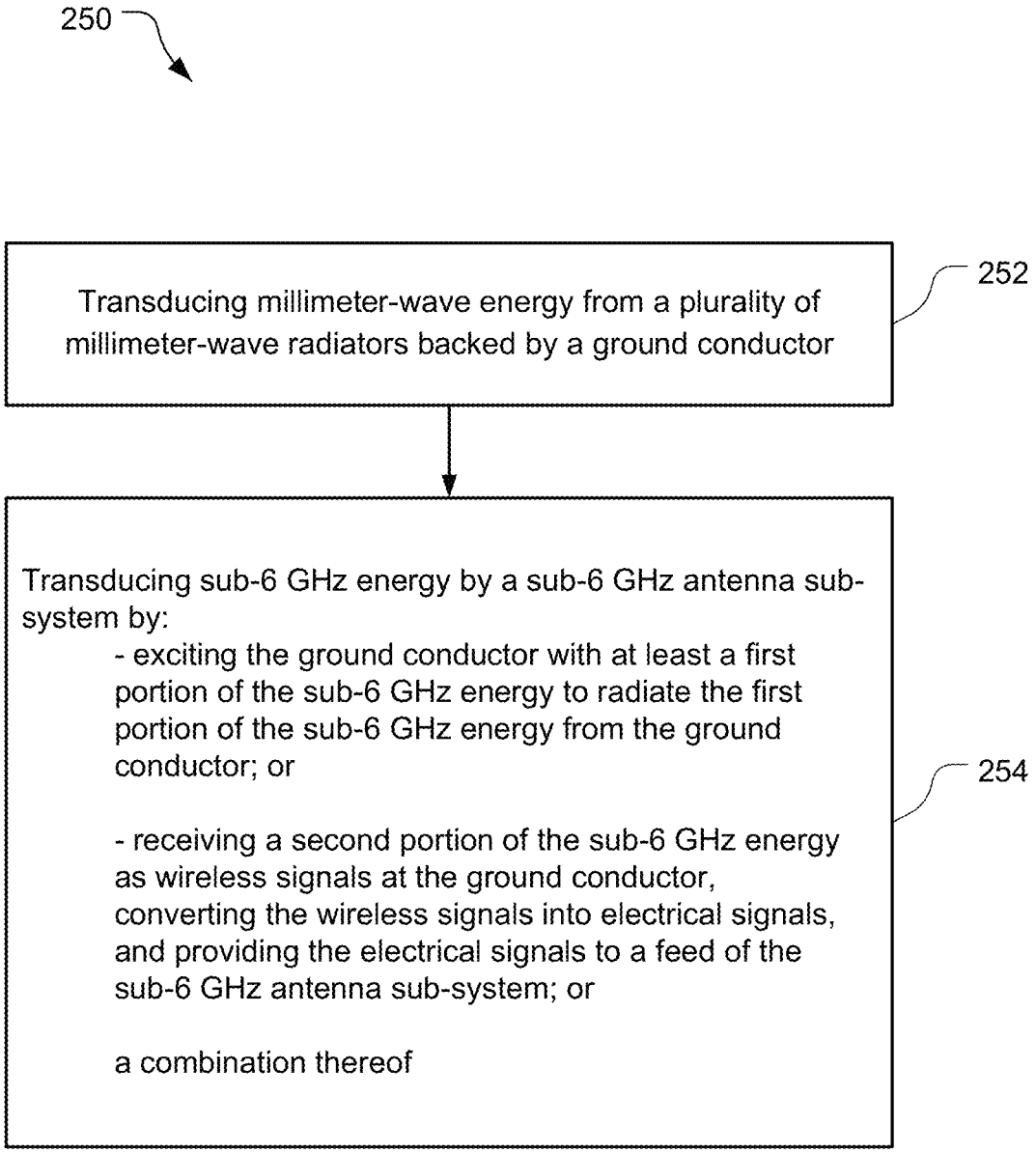
FIG. 16 is a block flow diagram of a method of transducing radio-frequency energy.

Referring to FIG. 16, with further reference to FIGS. 1-15, a method 250 of transducing radio-frequency signals includes the stages shown. The method 250 is, however, an example only and not limiting. The method 250 may be altered, e.g., by having stages added, removed, rearranged, combined, performed concurrently, and/or having single stages split into multiple stages.

At stage 252, the method 250 includes transducing millimeter-wave energy from a plurality of millimeter-wave radiators backed by a ground conductor. For example, the array 112 of the radiators 113-115 and/or the array 116 of the dipoles 118-119 of the antenna system 62 (or the antenna system 64) may transduce millimeter-wave energy, e.g., energy above 23 GHz such as at about 28 GHz, and may be backed by the ground conductor 122. The millimeter-wave energy (e.g., signals) may be provided to the array 112 and/or the array 116 by the front-end circuit 70 based on IF signals received from the IF circuit 74 via the feed 92 or the ground connection/feed 176, e.g., the FPC conveying the IF signals in flexible shielding conductive sheets. In this case, the received energy may be transduced and radiated by the array 112 and/or the array 116. The millimeter-wave energy may be received by the array 112 and/or the array 116 and transduced into electrical energy (e.g., signals) and provided to the front-end circuit 70. The array 112 and/or the array 116 (or antennas thereof) may provide means for transducing millimeter-wave energy.

At stage 254, the method 250 includes transducing sub-6 GHz energy by a sub-6 GHz antenna sub-system. For example, the sub-6 GHz frequency energy may have one or more frequencies from about 1.25 GHz to about 1.7 GHz (although one or more other frequency ranges may be used and/or the energy outside of this range may be coupled to the ground conductor). Transducing the sub-6 GHz energy may comprise exciting the ground conductor with at least a first portion of the sub-6 GHz energy to radiate the first portion of the sub-6 GHz energy from the ground conductor. Exciting the ground conductor may comprise capacitively coupling the first portion of the sub-6 GHz energy from a conductive portion, of the sub-6 antenna sub-system, to the ground conductor, the conductive portion being physically separate from the ground conductor. For example, sub-6 GHz energy may be provided from the feed 90 to the meander line 140, and the energy conveyed to the ground conductor, e.g., the ground conductor 122, by mutual coupling between the meander line 140 and the ground conductor 122 without there being a direct electrical connection between the meander line 140 and the ground conductor 122. In the example configuration shown in FIGS. 5-6 and 8-9, the sub-6 GHz energy is coupled from the meander line 140 to the ground conductor 122 along at least portions of at least three sides (e.g., along portions of the edges 152, 154, 156) of the ground conductor 122. More energy may be coupled to the ground conductor 122 than is radiated, but the sub-6 GHz energy that is eventually radiated by the ground conductor 122 is coupled, in this example, to the ground conductor 122 from the meander line 140. In the example configuration shown in FIG. 13, sub-6 GHz energy may be supplied through the ground connection/feed 176 (e.g., through the feed portion 184), or alternatively through the feed 188, to the ground plane 175, with the ground plane 175 receiving the sub-6 GHz energy and the ground plane 175 (and potentially the first portion 194 in some configurations) radiating the sub-6 GHz energy. In addition to or instead of exciting the ground conductor, transducing the sub-6 GHz energy may comprise receiving a second portion of the sub-6 GHz energy as wireless signals at the ground conductor, converting the wireless signals into electrical signals, and providing the electrical signals to a feed of the sub-6 GHz antenna sub-system. For example, in the configuration shown in FIGS. 5-6 and 8-9, wireless communication signals may be received by the ground conductor 122, capacitively coupled to the meander line 140, and conveyed as electrical signals by the meander line 140 to the feed 90. The ground conductor 122, the meander line 140, and the feed 90 may provide means for transducing sub-6 GHz energy. In the example configuration shown in FIG. 13, at least the ground plane 175 receives sub-6 GHz energy wirelessly and provides corresponding sub-6 GHz electrical signals to (the feed portion 184 of) the ground connection/feed 176, or to the feed 188, that conveys the received energy to an appropriate integrated circuit of a PCB (e.g., the PCB 66). The ground plane 175, the first portion 194 of the rim 180 in some configurations, and the ground connection/feed 176 (or the feed 188), may provide means for transducing sub-6 GHz energy.

Further, sub-6 GHz energy may be transduced by one or more components other than the ground conductor. For example, a monopole or loop may be used to transduce sub-6 GHz energy.

For example, the monopole sections 94, 96 may radiate and/or receive sub-6 GHz energy, such as signals with frequencies from about 700 MHz to about 960 MHz and/or from about 1.7 GHz to about 2.7 GHz. The monopole radiator, e.g., of the antenna sub-system 80, may receive energy provided via the feed 90, and transduce and radiate this energy. The energy travels through the meander line 140 and is radiated by the sections 94, 96 of the monopole radiator. This energy may have one or more frequencies, for example, within a range from about 700 MHz to about 960 MHz and/or from about 1.7 GHz to about 2.7 GHz (although one or more other frequency ranges may be used and/or the monopole may radiate energy outside of these ranges). Also or alternatively, wireless sub-6 GHz energy may be received by the monopole radiator of the antenna sub-system 80, transduced into electrical signals, and provided to the feed 90. Transducing sub-6 GHz energy may include tuning the monopole radiator to adjust a resonant frequency of the monopole radiator, e.g., providing a selected inductance of a variable inductance to the aperture tuner connection 98 from the aperture tuner 99 to cause the monopole radiator to transduce (convert from electrical signals to radiated wireless signals or to receive wireless signals and convert to electrical signals) well at a desired frequency range (e.g., a range within the 700 MHz-960 MHz range). Thus, the monopole radiator may also provide means for transducing sub-6 GHz energy.

OTHER CONSIDERATIONS

Configurations other than those shown may be used. For example, configurations where the antenna sub-system 81 is omitted may be used.

Also, as used herein, "or" as used in a list of items prefaced by "at least one of" or prefaced by "one or more of" indicates a disjunctive list such that, for example, a list of "at least one of A, B, or C," or a list of "one or more of A, B, or C" means A or B or C or AB or AC or BC or ABC (i.e., A and B and C), or combinations with more than one feature (e.g., AA, AAB, ABBC, etc.).

Substantial variations may be made in accordance with specific requirements. For example, customized hardware might also be used, and/or particular elements might be implemented in hardware, software (including portable software, such as applets, etc.) executed by a processor, or both. Further, connection to other computing devices such as network input/output devices may be employed.

The systems and devices discussed above are examples. Various configurations may omit, substitute, or add various procedures or components as appropriate. For instance, features described with respect to certain configurations may be combined in various other configurations. Different aspects and elements of the configurations may be combined in a similar manner. Also, technology evolves and, thus, many of the elements are examples and do not limit the scope of the disclosure or claims.

Specific details are given in the description to provide a thorough understanding of example configurations (including implementations). However, configurations may be practiced without these specific details. For example, well-known circuits, processes, algorithms, structures, and techniques have been shown without unnecessary detail in order to avoid obscuring the configurations. This description provides example configurations only, and does not limit the scope, applicability, or configurations of the claims. Rather, the preceding description of the configurations provides a description for implementing described techniques. Various changes may be made in the function and arrangement of elements without departing from the spirit or scope of the disclosure.

Having described several example configurations, various modifications, alternative constructions, and equivalents may be used without departing from the spirit of the disclosure. For example, the above elements may be components of a larger system, wherein other rules may take precedence over or otherwise modify the application of the invention. Also, a number of operations may be undertaken before, during, or after the above elements are considered. Accordingly, the above description does not bound the scope of the claims.

Further, more than one invention may be disclosed.

The invention claimed is:

1. An antenna system for transducing radio-frequency energy, the antenna system comprising:

a first antenna sub-system comprising a plurality of radiators and a ground conductor disposed in a module, each of the plurality of radiators being sized and shaped to transduce millimeter-wave energy between first wireless signals and first electrical current signals; and a second antenna sub-system comprising a first radiator configured to transduce sub-6 GHz energy between second wireless signals and second electrical current signals, wherein the first radiator comprises a conductive portion, physically separate from the module, and the ground conductor, wherein the ground conductor is electrically coupled to the conductive portion.

2. The antenna system of claim 1, wherein the conductive portion comprises a first section and a second section, the first section physically separated from the ground conductor by less than a twentieth of a wavelength of the sub-6 GHz energy over a majority of at least one edge of the ground conductor.

3. The antenna system of claim 2, wherein the first section comprises a meander line, of a monopole, that is disposed within the twentieth of the wavelength of the sub-6 GHz energy over a majority of a perimeter of the ground conductor to parasitically or capacitively couple the sub-6 GHz energy between the ground conductor and the meander line.

4. The antenna system of claim 3, wherein the ground conductor is rectangular with two length edges, a first width edge, and a second width edge, and the meander line is disposed within the twentieth of the wavelength of the sub-6 GHz energy over a majority of each of the two length edges, and a majority of the first width edge.

5. The antenna system of claim 2, wherein the ground conductor is planar, wherein the plurality of radiators overlap with the ground conductor transverse to a plane of the ground conductor, and wherein the second section does not overlap with the ground conductor transverse to the plane of the ground conductor.

6. The antenna system of claim 2, wherein the first section comprises a first monopole portion and the second section comprises a second monopole portion, the antenna system further comprising an aperture tuner communicatively coupled to the second monopole portion.

7. The antenna system of claim 1, wherein the second antenna sub-system defines an opening through which the millimeter-wave energy and the sub-6 GHz energy, from the ground conductor, can wirelessly pass.

8. The antenna system of claim 1, wherein a length of the ground conductor is an odd multiple of a quarter of a wavelength of the sub-6 GHz energy ±10% of the wavelength.

9. The antenna system of claim 1, further comprising a display, the first antenna sub-system and the second antenna sub-system extending outside a perimeter of the display by less than 10 mm.

10. The antenna system of claim 1, wherein the first antenna sub-system and the second antenna sub-system are collocated, with the first antenna sub-system being disposed inside a volume bounded by the second antenna sub-system.

11. The antenna system of claim 1, wherein the sub-6 GHz energy is first energy and has one or more first frequencies below 6 GHz, wherein the conductive portion comprises a first monopole portion and a second monopole portion, the first monopole portion and the second monopole portion being configured to, in combination, radiate second energy with one or more second frequencies below 6 GHz.

12. The antenna system of claim 11, wherein the one or more second frequencies are between 700 MHz and 960 MHz and/or between 1.7 GHz and 2.7 GHz, and the one or more first frequencies are between 1.25 GHz and 1.7 GHz.

13. The antenna system of claim 1, wherein the second antenna sub-system comprises a feed electrically coupled to the ground conductor.

14. The antenna system of claim 13, wherein the ground conductor is a first ground conductor, wherein the antenna system further comprises a printed circuit board that includes a second ground conductor, and wherein the first ground conductor is electrically connected to the second ground conductor.

15. The antenna system of claim 14, wherein the antenna system is disposed within a mobile device, and wherein the first ground conductor is rectangular and is connected to the second ground conductor via a conducting rim or frame of the mobile device.

16. The antenna system of claim 1, wherein the antenna system is disposed within a mobile device comprising a rim, and wherein the first antenna sub-system is disposed in a gap provided by the rim.

17. The antenna system of claim 16, wherein the first antenna sub-system is physically separate from the rim at at least one end of the gap.

18. The antenna system of claim 1, further comprising a first sub-system feed structure comprising a plurality of conductive lines configured to communicatively couple the plurality of radiators to millimeter-wave signal circuitry disposed on a printed circuit board, wherein the plurality of conductive lines are disposed between conductive sheets and the conductive sheets are configured to couple the ground conductor to a ground plane of the printed circuit board.

19. The antenna system of claim 1, wherein the conductive portion comprises an inverted-F antenna having a first conductor end, a second conductor end, and an intermediate point between the first and second conductor ends, the second antenna sub-system including a first electrical connection coupled between the first conductor end and circuitry configured to at least one of supply the sub-6 GHz energy or receive the sub-6 GHz energy, the second antenna sub-system further including a second electrical connection coupled between the intermediate point and a ground plane of a device including the antenna system, the second conductor end being open.

20. The antenna system of claim 1, wherein the conductive portion comprises an inverted-F antenna having a first conductor end, a second conductor end, and an intermediate point between the first and second conductor ends, the second antenna sub-system including a first electrical connection coupled between the intermediate point and circuitry configured to at least one of supply the sub-6 GHz energy or receive the sub-6 GHz energy, the second antenna sub-system further including a second electrical connection coupled between the first conductor end and a ground plane of a device including the antenna system, the second conductor end being open.

21. The antenna system of claim 1, wherein the antenna system is disposed within a wireless device, and wherein the antenna system further comprises an aperture tuner coupled between the first radiator of the second antenna sub-system and a ground plane of the wireless device.

22. The antenna system of claim 1, wherein the conductive portion comprises a loop antenna with a feed coupled between a first end of the second antenna sub-system and circuitry configured to at least one of supply the sub-6 GHz energy or receive the sub-6 GHz energy, and with a ground connection coupled between a second end of the second antenna sub-system and a ground plane of a device including the antenna system.

23. The antenna system of claim 1, wherein the first electrical current signals correspond to millimeter wave signals, and wherein the module further comprises circuitry configured to upconvert intermediate-frequency signals to the first electrical current signals or to downconvert the first electrical current signals to intermediate-frequency signals.

24. A method of transducing radio-frequency energy, the method comprising:

transducing millimeter-wave energy by a plurality of millimeter-wave radiators backed by a ground conductor; and transducing sub-6 GHz energy by a sub-6 GHz antenna sub-system by:

exciting the ground conductor with at least a first portion of the sub-6 GHz energy to radiate the first portion of the sub-6 GHz energy from the ground conductor; or receiving a second portion of the sub-6 GHz energy as wireless signals at the ground conductor, converting the wireless signals into electrical signals, and providing the electrical signals to a feed of the sub-6 GHz antenna sub-system; or a combination thereof, wherein transducing the sub-6 GHz energy comprises transducing first energy with one or more first frequencies between 700 MHz and 960 MHz and/or between 1.7 GHz and 2.7 GHz using a monopole that is separate from the ground conductor, and transducing second energy with one or more second frequencies between 1.25 GHz and 1.7 GHz using the ground conductor, and wherein the millimeter-wave energy has one or more frequencies above 23 GHz.

25. The method of claim 24, wherein exciting the ground conductor comprises capacitively coupling the first portion of the sub-6 GHz energy from a conductive portion of the sub-6 GHz antenna sub-system to the ground conductor, the conductive portion being physically separate from the ground conductor.

26. The method of claim 25, wherein the capacitively coupling comprises capacitively coupling the first portion of the sub-6 GHz energy from a meander line to the ground conductor.

27. The method of claim 26, wherein the capacitively coupling comprises coupling the first portion of the sub-6 GHz energy from the meander line to the ground conductor along at least portions of at least three edges of the ground conductor.

28. The method of claim 24, further comprising tuning the monopole to adjust a resonant frequency of the monopole.

29. The method of claim 24, wherein exciting the ground conductor comprises electrically connecting a sub-6 GHz signal to the ground conductor.

* * * * *